US010400429B2

(12) United States Patent
Eads et al.

(10) Patent No.: US 10,400,429 B2
(45) Date of Patent: Sep. 3, 2019

(54) FAUCET INCLUDING AN OPEN WATERWAY

(71) Applicant: Delta Faucet Company, Indianapolis, IN (US)

(72) Inventors: Thad James Eads, Urbana, IN (US); Michael Scot Rosko, Greenwood, IN (US); Kyle Robert Davidson, Noblesville, IN (US); Gerald R. Hayes, Lebanon, IN (US)

(73) Assignee: Delta Faucet Company, Indianapolis, IN (US)

( * ) Notice: Subject to any disclaimer, the term of this patent is extended or adjusted under 35 U.S.C. 154(b) by 0 days.

(21) Appl. No.: 15/768,412

(22) PCT Filed: Oct. 19, 2016

(86) PCT No.: PCT/US2016/057742
§ 371 (c)(1),
(2) Date: Apr. 13, 2018

(87) PCT Pub. No.: WO2017/070232
PCT Pub. Date: Apr. 27, 2017

(65) Prior Publication Data

US 2018/0298595 A1 Oct. 18, 2018

Related U.S. Application Data

(60) Provisional application No. 62/243,414, filed on Oct. 19, 2015.

(51) Int. Cl.
*E03C 1/04* (2006.01)

(52) U.S. Cl.
CPC ..... *E03C 1/0407* (2013.01); *E03C 1/0412* (2013.01)

(58) Field of Classification Search
CPC ..... E03C 1/0407
(Continued)

(56) References Cited

U.S. PATENT DOCUMENTS 2,524,956 A 10/1950 Brunetti
2,585,997 A 2/1952 Bruewer
(Continued)

FOREIGN PATENT DOCUMENTS

EP 2 733 269 5/2014

OTHER PUBLICATIONS

Ivy Chen, Vortex, retrieved from http://www.zevalife.com/news/, 1 page, at least as early as Jul. 2014.
(Continued)

*Primary Examiner* — Lori L Baker
(74) *Attorney, Agent, or Firm* — Faegre Baker Daniels LLP

(57) ABSTRACT

A faucet including a spout having a passageway configured to receive water from a water source. An open chamber is coupled to the passageway. The open chamber extends from a first side of the spout to a second side of the spout. The second side is opposite the first side. A trough is disposed within the open chamber of the spout. The trough is configured to receive water from the passageway. A spillway is disposed within the open chamber of the spout. The spillway includes a crest coupled to the trough, the crest being configured to permit water in the trough to flow thereover. A chute wall is coupled to the crest, the chute wall being configured to receive water flowing over the crest. An outlet is defined by the chute wall at the second side of the spout, the outlet being configured to deliver water from the faucet.

29 Claims, 20 Drawing Sheets

(58) Field of Classification Search
USPC ..... 4/678
See application file for complete search history.

(56) References Cited

U.S. PATENT DOCUMENTS

| | | | |
|---|---|---|---|
| 6,352,183 | B1 | 3/2002 | Kristiansen et al. |
| 6,412,782 | B1 | 7/2002 | Rivet et al. |
| D737,941 | S | 9/2015 | Eads |
| D767,725 | S | 9/2016 | Eads |
| D767,727 | S | 9/2016 | Eads |
| D769,418 | S | 10/2016 | Eads |
| D769,419 | S | 10/2016 | Eads |
| 2003/0006314 | A1 | 1/2003 | Chao |
| 2005/0223490 | A1 | 10/2005 | Kunkel |
| 2013/0291977 | A1 | 11/2013 | Chung |

OTHER PUBLICATIONS

International Search Report and Written Opinion for PCT/US2016/057742 dated Jan. 24, 2017, 8 pages.

FAUCET INCLUDING AN OPEN WATERWAY

CROSS-REFERENCE TO RELATED APPLICATIONS

This application is a U.S. 371 national phase filing of PCT International Application No. PCT/US2016/057742, filed Oct. 19, 2016, which claims the benefit of U.S. Provisional Patent Application Ser. No. 62/243,414, filed Oct. 19, 2015, the disclosures of which are expressly incorporated herein by reference.

BACKGROUND AND SUMMARY OF THE DISCLOSURE

The present disclosure generally relates to a faucet for delivering water. The present disclosure particularly relates to a faucet that includes an open waterway for viewing water flowing through the faucet before being delivered by the faucet.

Aesthetic appeal of faucets is typically considered in terms of externally visible surface shapes and materials. Faucets typically include few visible moving components, other than, in some cases, a handle that is manipulated to selectively deliver water therefrom. Similarly, flowing water is typically only visible after delivery from faucets. As a result, faucets typically have a static appearance that limits overall aesthetic appeal.

According to an illustrative embodiment of the present disclosure, a faucet includes a spout. The spout includes a passageway configured to receive water from a water source. An open chamber is coupled to the passageway. The open chamber extends from a first side of the spout to a second side of the spout. The second side is opposite the first side. A trough is disposed within the open chamber of the spout. The trough is configured to receive water from the passageway. A spillway is disposed within the open chamber of the spout. The spillway includes a crest coupled to the trough, the crest being configured to permit water in the trough to flow thereover. A chute wall is coupled to the crest, the chute wall being configured to receive water flowing over the crest. An outlet is defined by the chute wall at the second side of the spout, the outlet being configured to deliver water from the faucet. A plurality of ribs are disposed adjacent to the spillway, the plurality of ribs being configured to at least one of reduce turbulence of water flowing over the spillway and control a direction of water flowing over the spillway.

According to another illustrative embodiment of the present disclosure, a faucet includes a spout. The spout includes a passageway configured to receive water from a water source. An open chamber is coupled to the passageway. The open chamber extends from a first side of the spout to a second side of the spout, the second side being opposite the first side. A trough is disposed within the open chamber of the spout. The trough is configured to receive water from the passageway. A spillway is disposed within the open chamber of the spout. The spillway includes a crest coupled to the trough, the crest being configured to permit water in the trough to flow thereover. A chute wall is coupled to the crest, the chute wall being configured to receive water flowing over the crest. An outlet is defined by the chute wall at the second side of the spout, the outlet being configured to deliver water from the faucet. A baffle wall is disposed within the trough, the baffle wall being configured to direct water received from the passageway transversely relative to the spillway and the outlet.

According to another illustrative embodiment of the present disclosure, a faucet includes a spout having a passageway configured to receive water from a water source. An open chamber is coupled to the passageway and extends from a first side of the spout to a second side of the spout, the second side being opposite the first side. A base is disposed within the open chamber of the spout and includes a trough, the trough including an inlet configured to receive water from the passageway. A spillway is disposed within the open chamber of the spout. The spillway includes a crest coupled to the trough, the crest being configured to permit water in the trough to flow thereover. A chute wall is coupled to the crest, the chute wall being configured to receive water flowing over the crest. An outlet is defined by the chute wall at the second side of the spout, the outlet being configured to deliver water from the faucet. A baffle is coupled to the base and is configured to direct water received from the through relative to the spillway and the outlet, the baffle including a baffle wall having a plurality of openings to provide fluid communication between the trough and the crest, and a plurality of flow directing ribs supported by the baffle wall to control water flow over the crest.

Additional features and advantages of the present disclosure will become apparent to those skilled in the art upon consideration of the following detailed description of illustrative embodiments of the present disclosure.

DETAILED DESCRIPTION OF THE DRAWINGS

The embodiments of the disclosure described herein are not intended to be exhaustive or to limit the disclosure to the precise forms disclosed. Rather, the embodiments described herein enable one skilled in the art to practice the disclosure.

Figure 1:
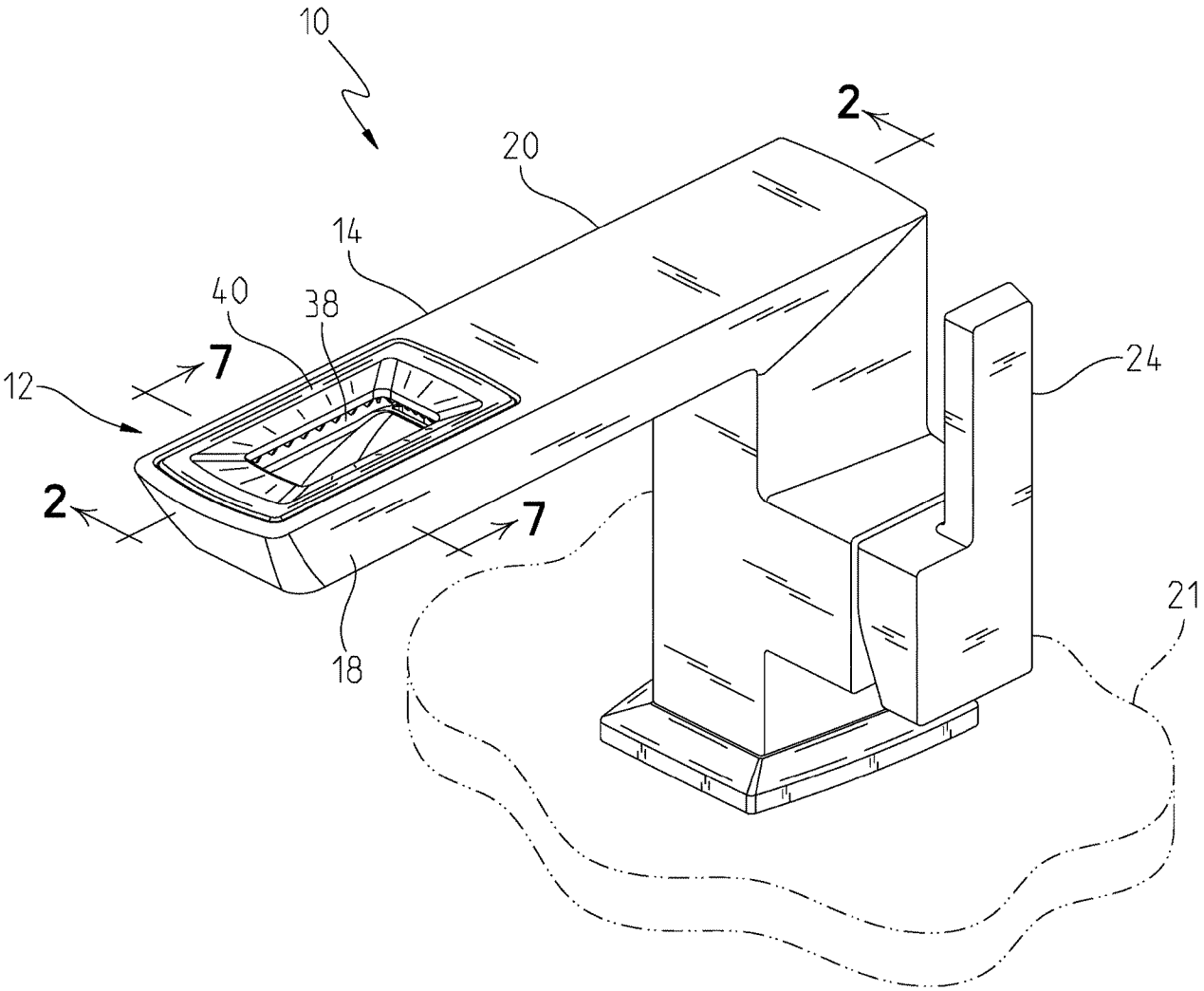
FIG. 1 is a top perspective view of an illustrative faucet including an open waterway.
Figure 2:
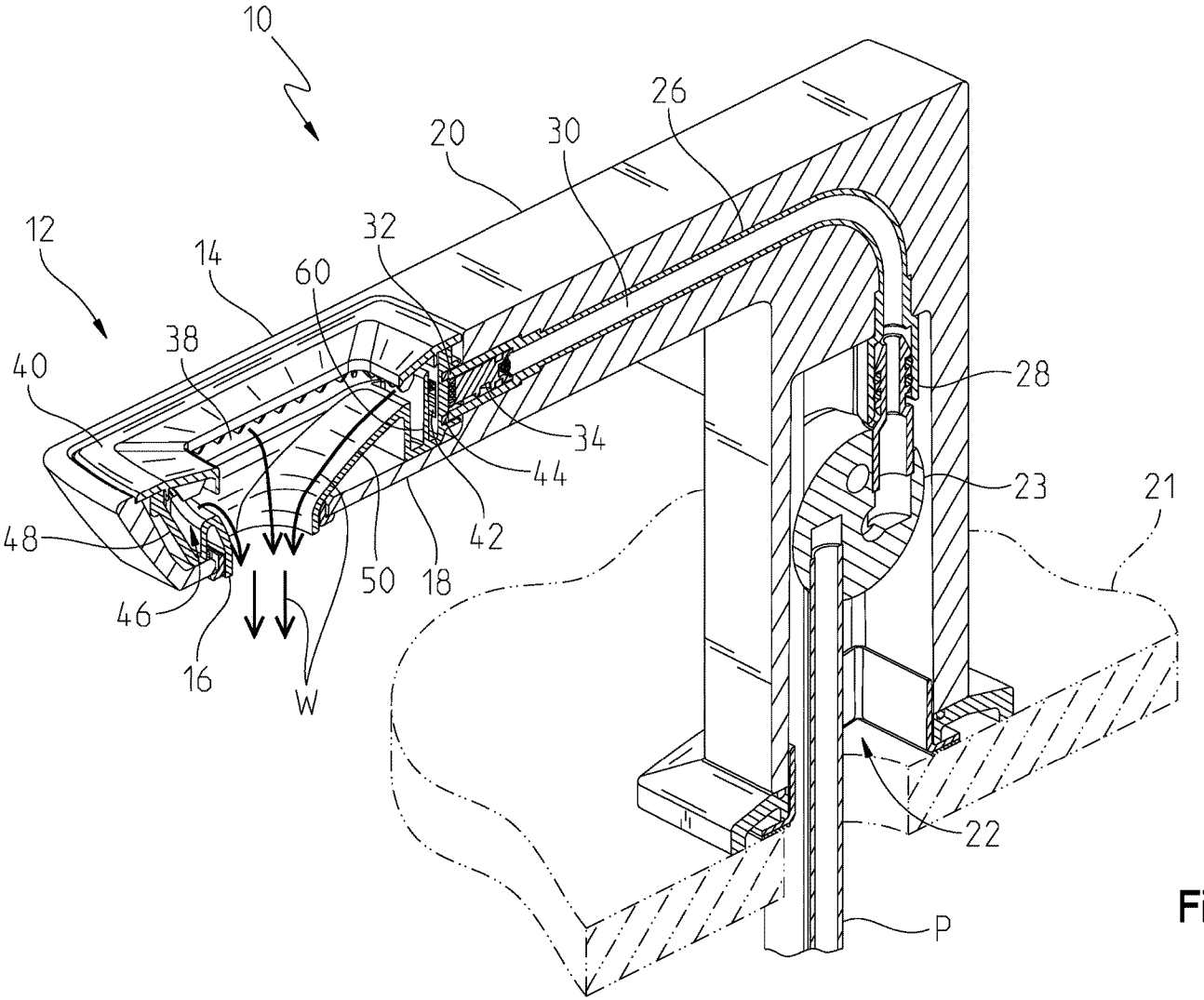
FIG. 2 is a top perspective cross-sectional view of the illustrative faucet of FIG. 1 along line 2-2.
Figure 3:
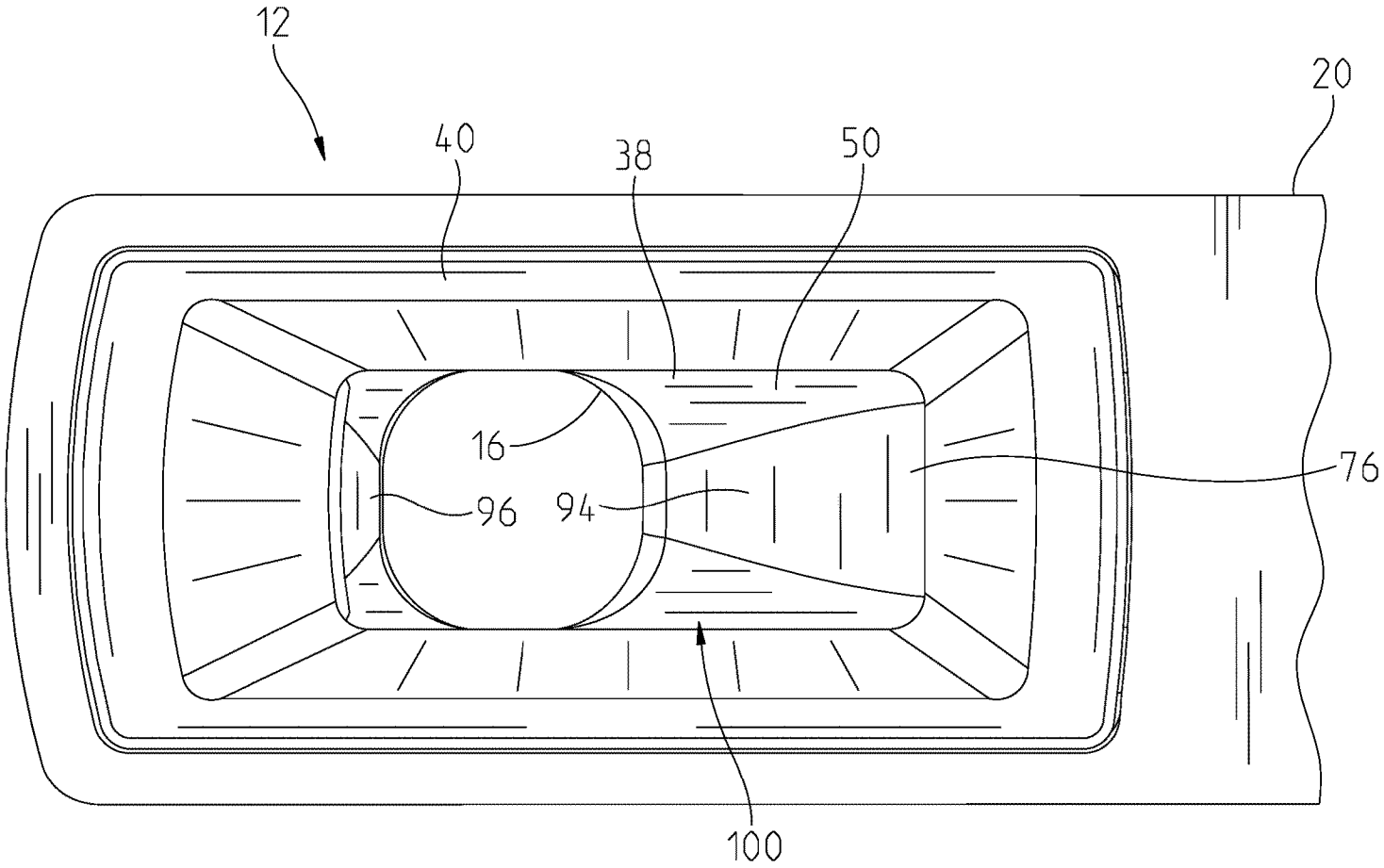
FIG. 3 is a top plan view of the open waterway of the illustrative faucet of FIG. 1.
Figure 4:
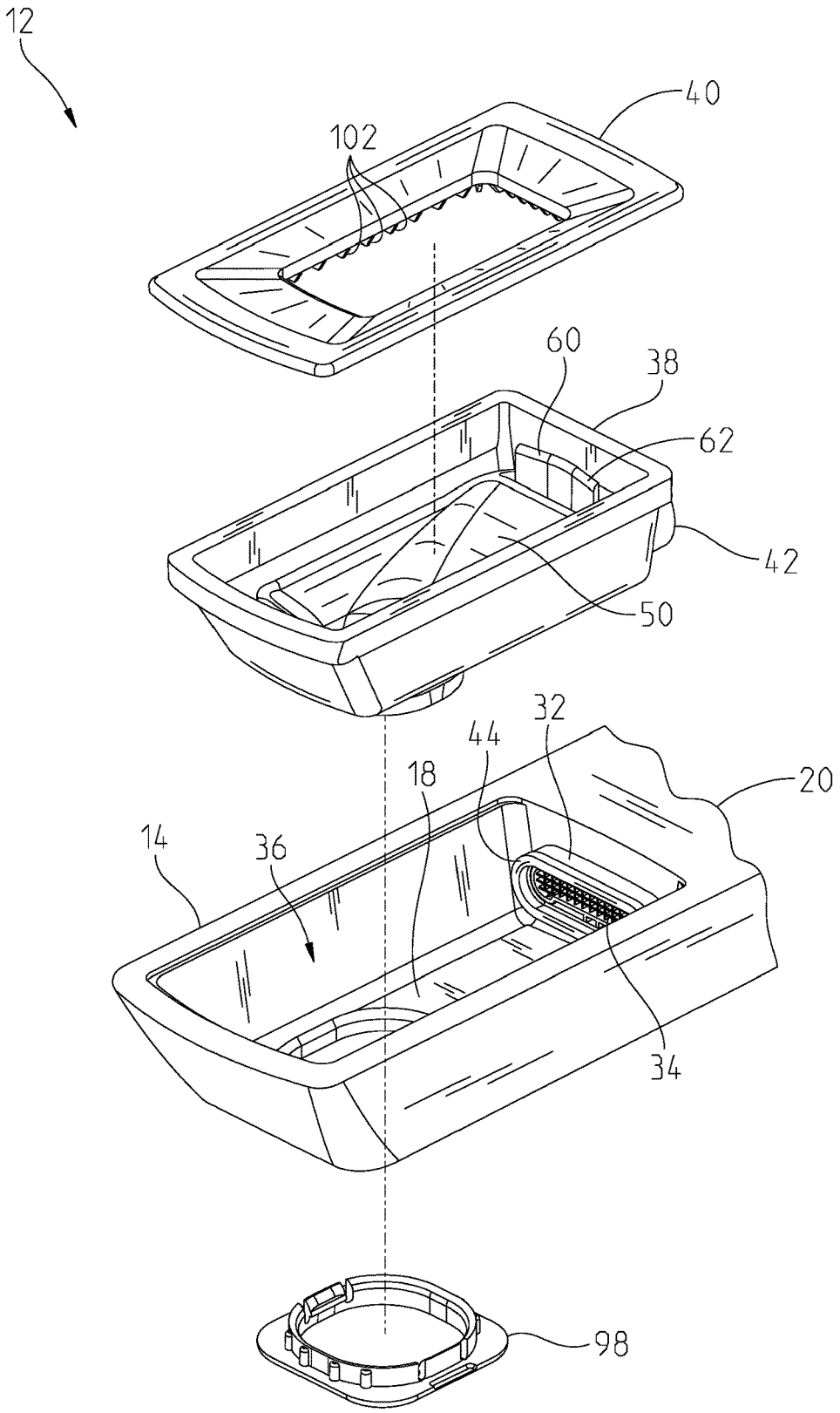
FIG. 4 is a top exploded perspective view of the open waterway of the illustrative faucet of FIG. 1.
Figure 5:
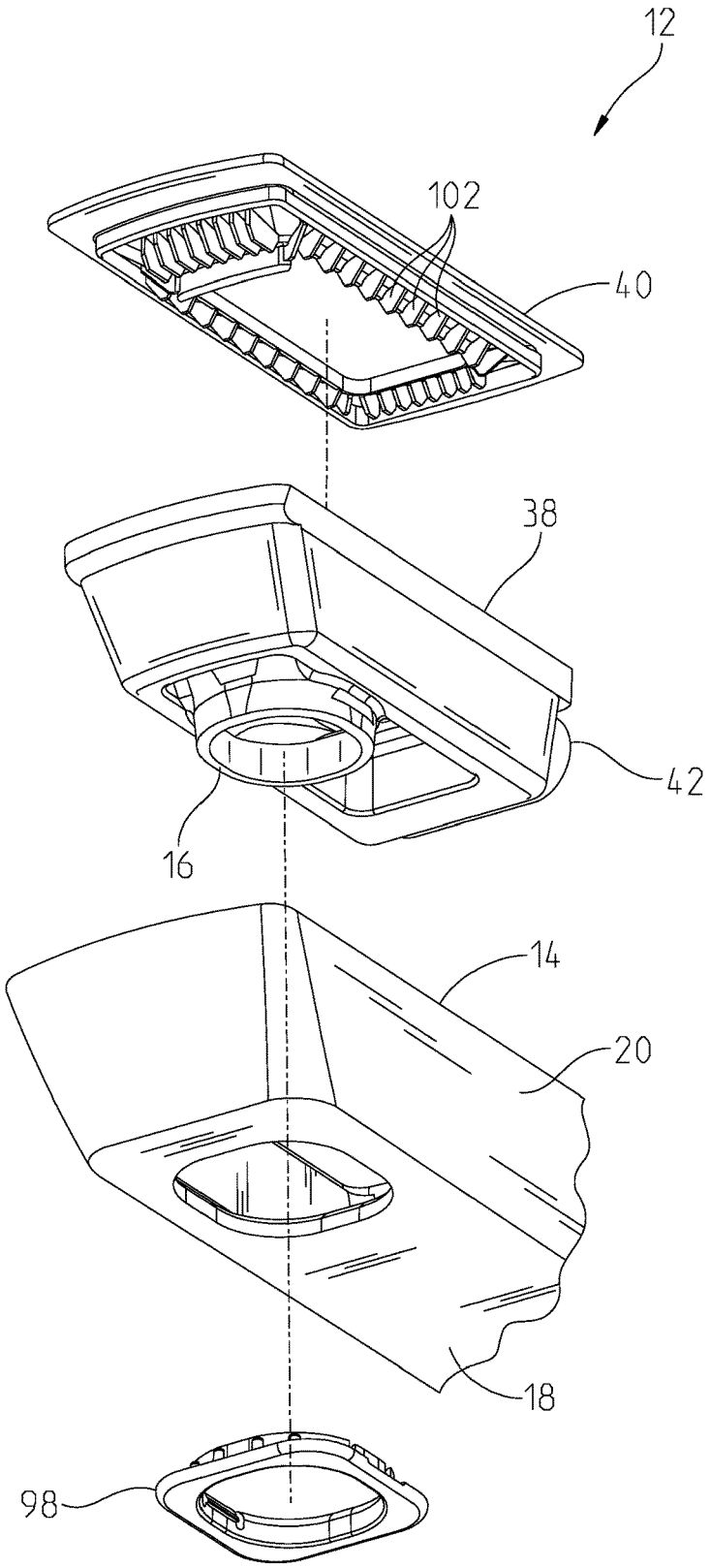
FIG. 5 is a bottom exploded perspective view of the open waterway of the illustrative faucet of FIG. 1.

With reference initially to FIGS. 1 and 2, the illustrative faucet 10 of the present disclosure is configured to receive water from a water source, such as one or more pipes P. The faucet 10 generally includes an open waterway 12. Flow of water W (see FIG. 2) in the open waterway 12 is visible from a first, or top, side 14 of the faucet 10 prior to delivery of the water W from an outlet 16 on an opposite second, or bottom, side 18 of the faucet 10. Illustratively, water W flows uniformly in different portions of the open waterway 12. These and other aspects of the faucet 10 are described further in the following paragraphs.

With continued reference to FIGS. 1 and 2, the faucet 10 includes a spout 20 supported by a mounting deck, illustratively a sink deck 21. The spout 20 may comprise one or more of various materials, such as metals (for example, brass) or non-metals (for example, thermoplastic or concrete). The spout 20 may comprise various cross-sectional shapes, including rectangular (including square) and round (including circular). Illustratively, the spout 20 generally includes a "carpenter square" shape, although various other shapes may alternatively be used.

The spout 20 includes an internal passageway 22 for receiving the pipe P. Within the internal passageway 22, the spout 20 illustratively carries a valve 23 assembly for coupling to the pipe P, receiving water therefrom, and selectively delivering water from the faucet 10. The valve 23 couples to a user-operated component, such as a rotatable handle 24, to facilitate selectively delivering water from the faucet 10 via the valve 23. As a specific example, the valve 23 may be a conventional mixing valve coupled to a hot water pipe and a cold water pipe. For such a mixing valve, the handle 24 may be manipulated to control both the flow rate and temperature of water delivered from the faucet 10. Alternatively, the spout 20 may lack a valve 23 and a user-operated component, and the faucet 10 may be used in connection with one or more knob-type or lever-type handle assemblies that each include a valve (not shown). That is, the water source may receive water from one or more knob-type or lever-type handle assemblies. The handle assemblies may include, for example, a "hot water" handle and a "cold water" handle.

Within the internal passageway 22 of the spout 20, the spout 20 also carries a conduit 26. The conduit 26 includes an inlet 28 that couples to, and receives water from, the valve 23. The inlet 28 is coupled to, and delivers water to, an internal passageway 30 of the conduit 26. The internal passageway 30 is coupled to, and delivers water to, an outlet 32 of the conduit 26. Illustratively, the conduit 26 carries a water conditioner 34 proximate the outlet 32. Water flows through the water conditioner 34 to facilitate one or more of aeration, stream-straightening (that is, reducing turbulence), and limiting the flow rate of water through the faucet 10. The water conditioner 34 may limit or restrict the flow rate of water through the faucet 10 to, for example, about 1.2 gallons per minute (that is, 1.2 gallons per minute±10 percent).

With reference to FIGS. 3-12, the conduit 26 delivers water to the open waterway 12. Generally, the open waterway 12 includes an open chamber 36 formed in the spout 20 (FIGS. 4 and 6), a base 38 (FIGS. 4 and 5) carried by the spout 20 and disposed within the open chamber 36, and a cover 40 (FIGS. 4, 5 and 9) carried by the base 38 and disposed within the open chamber 36.

Figure 6:
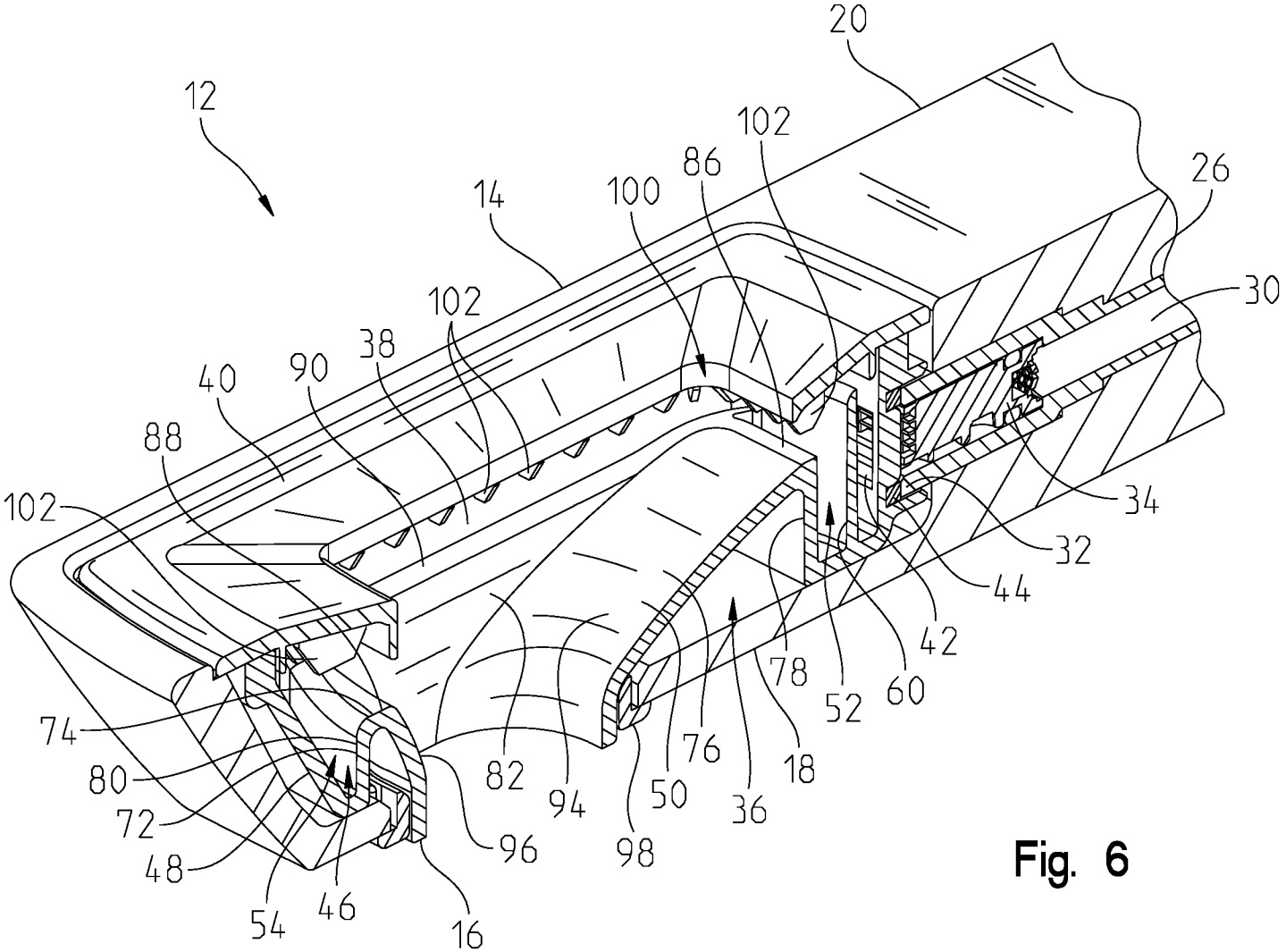
FIG. 6 is a top perspective section view of the open waterway along line 2-2 of FIG. 1.
Figure 7:
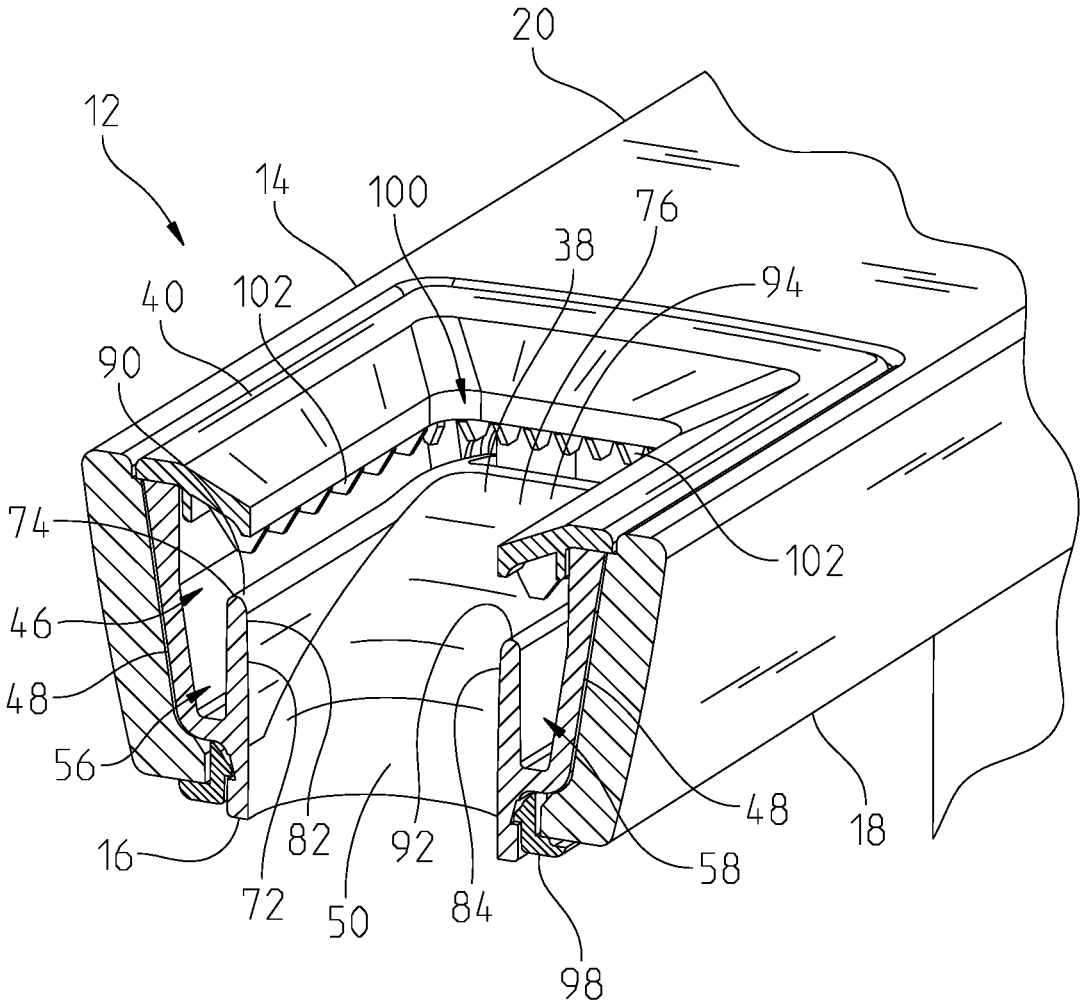
FIG. 7 is a top perspective section view of the open waterway along line 7-7 of FIG. 1.

With specific reference to FIGS. 6 and 7, the open chamber 36 of the spout 20 extends from the first side 14 of the spout 20 (for example, the top) to the second side 18 of the spout 20 (for example, the bottom). Illustratively, the open chamber 36 has a relatively large area at the first side 14 of the spout 20 and a relatively small area at the second side 18 of the spout 20. For example, the area of the open chamber 36 at the first side 14 may be from about two times (that is, two times±10 percent) to about five times (that is, five times±10 percent) the area of the open chamber 36 at the second side 18.

Figure 10:
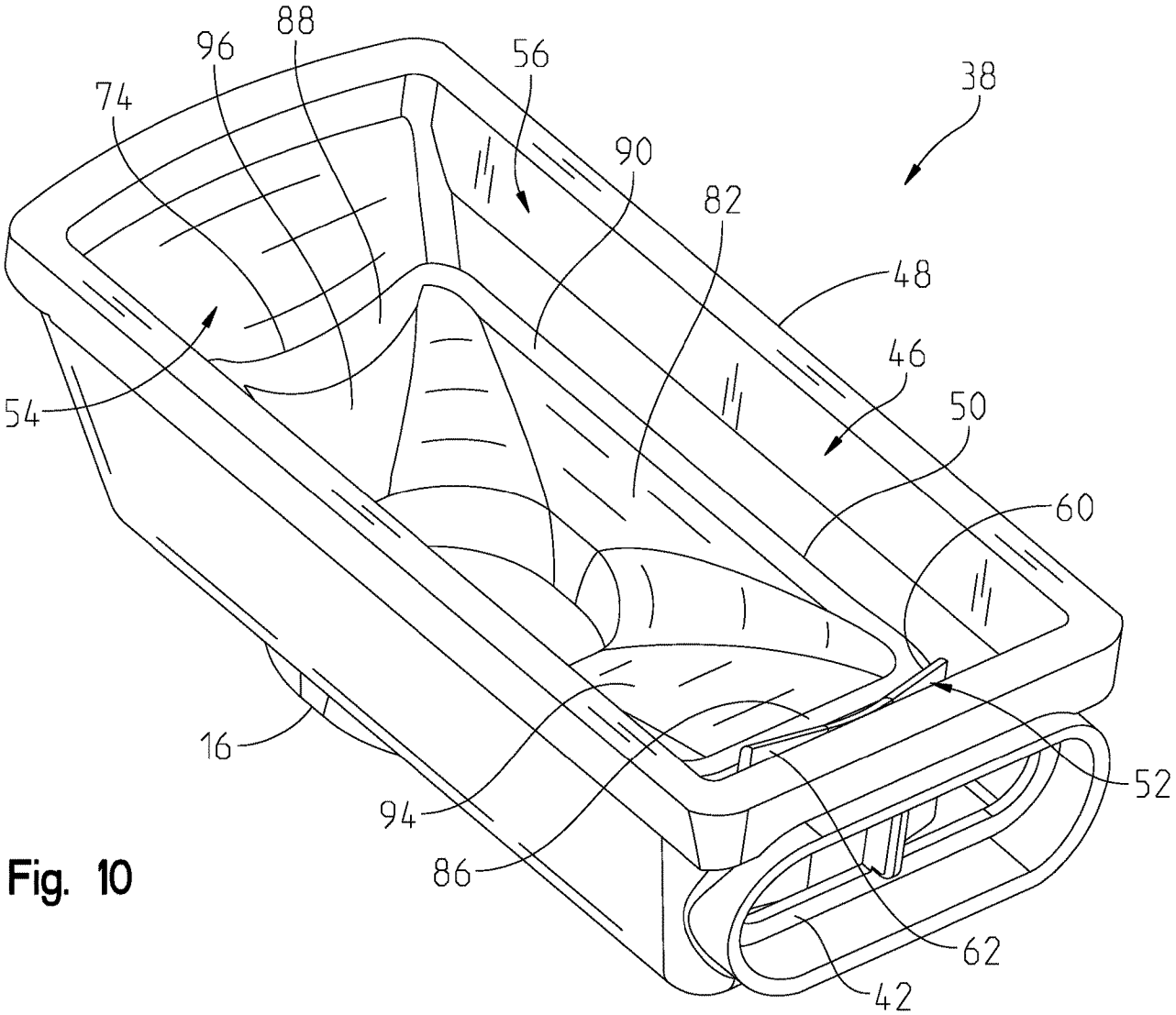
FIG. 10 is a top perspective view of the waterway base of the faucet of FIG. 1.

With specific reference now to FIGS. 7 and 10, the base 38 may comprise one or more of various materials, such as metals (for example, stainless steel) or non-metals (for example, porcelain) Illustratively, the base 38 is formed separately from the spout 20. Alternatively, the features of the base 38 described below could be monolithically formed with the spout 20 (for example, by machining, molding, forging and/or casting).

The base 38 includes an inlet 42 that couples to, and receives water from, the conduit 26. The inlet 42 may press-fittingly couple to the conduit 26, and a face seal 44 may be disposed therebetween (FIG. 6). Illustratively, the inlet 42 may have a general oval shape.

The base 38 further includes a trough 46 that receives water from the inlet 42. The trough 46 is defined between an outer wall 48 of the base 38 and a spillway 50 of the base 38. Illustratively, the trough 46 includes a first trough portion 52, a second trough portion 54, a third trough portion 56, and a fourth trough portion 58. The first trough portion 52 is adjacent to the inlet 42. The second trough portion 54 is opposite the first trough portion 52, such that the spillway 50 is disposed between the second trough portion 54 and the first trough portion 52. The third trough portion 56 extends between the first trough portion 52 and the second trough portion 54. The fourth trough portion 58 is opposite the third trough portion 56 and extends between the first trough portion 52 and the second trough portion 54, such that the spillway 50 is disposed between the fourth trough portion 58 and the third trough portion 56.

Illustratively, the base 38 may include a baffle wall 60 disposed within the first trough portion 52. The baffle wall 60 generally extends in a direction perpendicular to a direction extending between the inlet 42 and the outlet 16. The baffle wall 60 may include a convex surface 62 that faces toward the inlet 42. The baffle wall 60 directs water in the first trough portion 52 transversely relative to the spillway 50 and the outlet and toward the third trough portion 56 and the fourth trough portion 58. The third trough portion 56 and the fourth trough portion 58 deliver water to the second trough portion 54.

Figure 8:
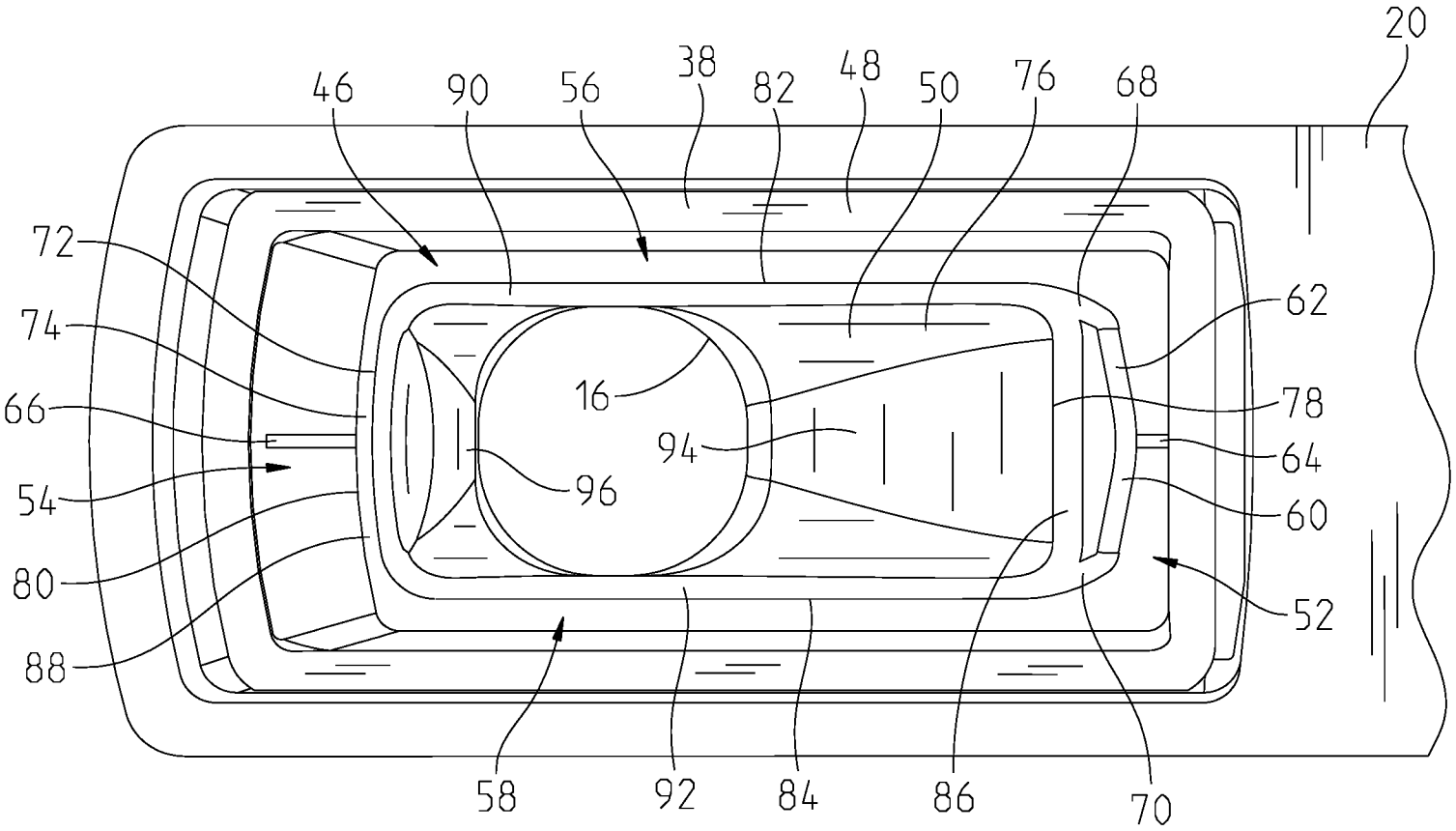
FIG. 8 is a top plan view of a spout of the faucet of FIG. 1, with the cover removed for clarity.
Figure 9:
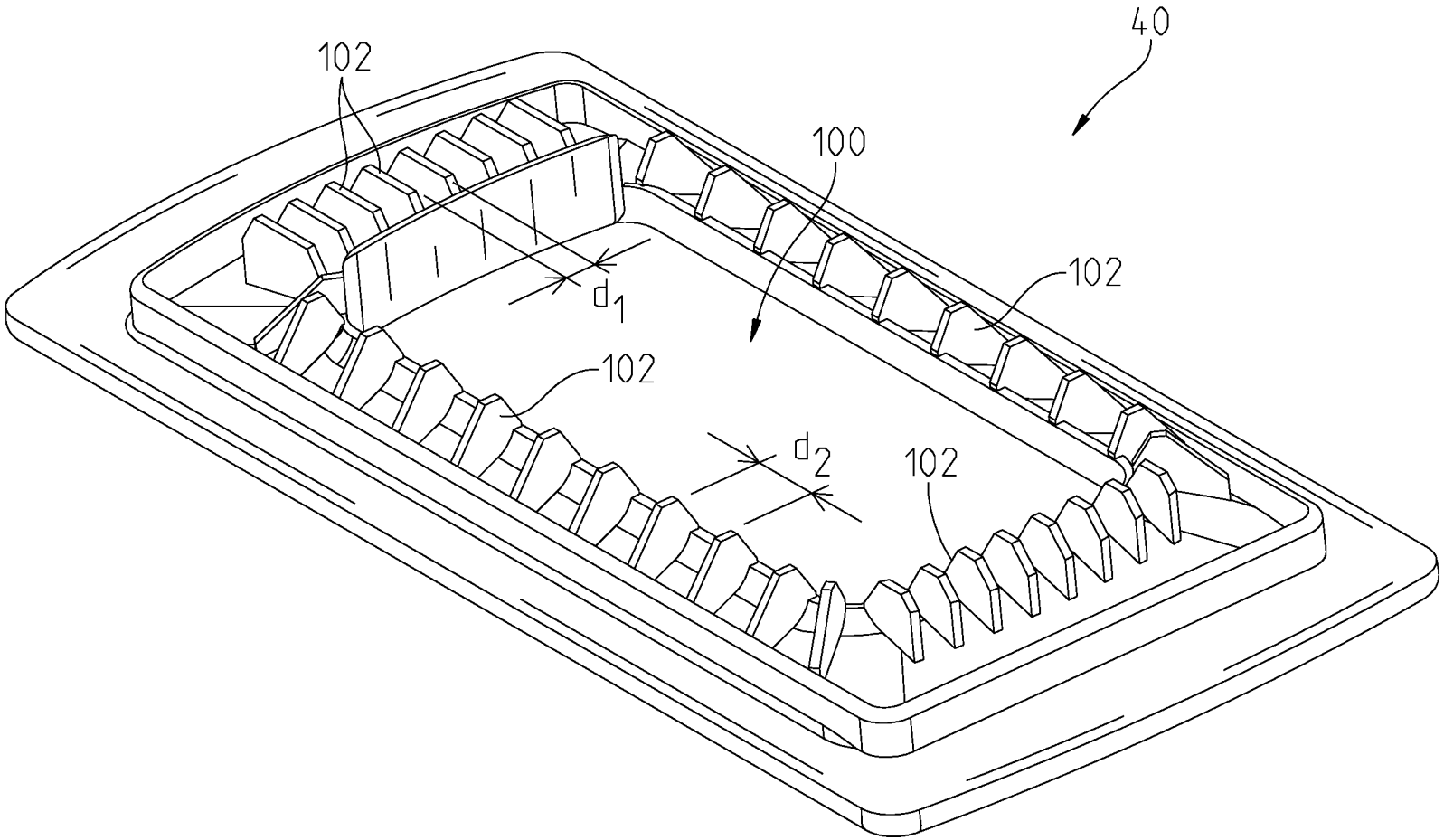
FIG. 9 is a bottom perspective view of the waterway cover of the illustrative faucet of FIG. 1.

With specific reference to FIG. 8, illustratively, the base 38 includes a first partition 64 and a second partition 66 disposed in the first trough portion 52 and the second trough portion 54, respectively. The first partition 64 and the second partition 66 may generally extend in a direction parallel to the direction extending between the inlet 42 and the outlet 16. Illustratively, the base 38 also includes a third partition 68 and a fourth partition 70 disposed in the first trough portion 52. The third partition 68 and the fourth partition 70 couple sides of the baffle wall 60 to the spillway 50.

With further reference to FIGS. 2, 6-8 and 10, the trough 46 extends about the spillway 50. Illustratively, the trough 46 continuously extends about the spillway 50 except at the partitions 64 and 66. The spillway 50 generally includes a side wall 72, a crest 74, and a chute wall 76. The side wall 72 is adjacent to and partially defines, together with the outer wall 48, the trough 46. The side wall 72 includes a first side wall portion 78, a second side wall portion 80, a third side wall portion 82, and a fourth side wall portion 84. The first side wall portion 78 is adjacent to the first trough portion 52. The second side wall portion 80 is adjacent to the second trough portion 54. The third side wall portion 82 is adjacent to the third trough portion 56. The fourth side wall portion 84 is adjacent to the fourth trough portion 58.

The crest 74 receives water from the trough 46, and water flows over the crest 74. The crest 74 includes a first crest portion 86 coupled to the first side wall portion 78, a second crest portion 88 coupled to the second side wall portion 80, a third crest portion 90 coupled to the third side wall portion 82, and a fourth crest portion 92 coupled to the fourth side wall portion 84. The crest portions 86, 88, 90, and 92 may be disposed at appropriate perpendicular distances from the outlet 16 (that is, distances in a direction extending perpendicularly between the first side 14 of the spout 20 and the second side 18 of the spout 20) to facilitate uniform water flow over each of the crest portions 86, 88, 90, and 92. That is, the first crest portion 86 is disposed at a first perpendicular distance from the outlet 16. The second crest portion 88 is disposed at a second perpendicular distance from the outlet 16. The second perpendicular distance may be less than the first perpendicular distance. For example, the second perpendicular distance may be from about 95 percent (that is, 95 percent±2 percent) to about 80 percent (that is, 80 percent±2 percent) of the first perpendicular distance. The third crest portion 90 is disposed at a third perpendicular distance from the outlet 16. The third perpendicular distance may be less than the first perpendicular distance. For example, the third perpendicular distance may be from about 95 percent (that is, 95 percent±2 percent) to about 80 percent (that is, 80 percent±2 percent) of the first perpendicular distance. The fourth crest portion 92 is disposed at a fourth perpendicular distance from the outlet 16. The fourth perpendicular distance may be approximately equal to the first perpendicular distance (that is, equal±2 percent).

The chute wall 76 receives water flowing over the crest 74. The chute wall 76 includes a first chute wall portion 94 coupled to the first crest portion 86, and a second chute wall portion 96 coupled to the second crest portion 88. The third side wall portion 82 acts as a third chute wall portion, and the fourth side wall portion 84 acts as a fourth chute wall portion. Illustratively, water flows uniformly over the different chute wall portions 94, 96, 82, and 84. Illustratively, the chute wall portions 94, 96, 82, and 84 include curved surfaces that lack abrupt edges therebetween. The chute wall portions 94, 96, 82, and 84 may be disposed at different angles relative to the outlet 16. For example, the first chute wall portion 94 may be disposed at a first angle relative to the outlet 16, the second chute wall portion 96 may be disposed at a second angle relative to the outlet 16, and the second angle may be greater than the first angle. The third chute wall portion (that is, the third side wall portion 82) may be disposed at a third angle relative to the outlet 16, and the third angle may be greater than the second angle. The fourth chute wall portion (that is, the fourth side wall portion) may be disposed at a fourth angle relative to the outlet 16, and the fourth angle may be greater than the second angle. The chute wall portions 94, 96, 82, and 84 converge, proceeding from the first side 14 of the spout 20 toward the second side 18 of the spout 20, to define the outlet 16 at the second side 18 of the spout 20.

The outlet 16 may be disposed below the spout 20 to inhibit water from clinging to the second side 18 of the spout 20. Illustratively, the outlet 16 couples to the second side 18 of the spout 20 via a generally annular shaped retainer 98.

With reference to FIGS. 3-7 and 9, the cover 40 is carried by the base 38 and is disposed within the open chamber 36. The cover 40 may comprise one or more of various materials, such as metals (for example, stainless steel) or non-metals (for example, porcelain or plastic with or without plating). The cover 40 may comprise the same material as the base 38 or a different material than the base 38. Illustratively, the cover 40 and the base 38 are coupled via an adhesive (for example, epoxy, double-sided tape, or the like). Alternatively, the cover 40 and the base 38 are monolithically coupled (for example, by forming the components together via molding or 3D printing).

The cover 40 includes an aperture 100 that overlies the chute wall 76 and the outlet 16. As such, the aperture 100 facilitates visibility of water flowing over the chute wall 76 toward the outlet 16. The cover 40 also includes a plurality of ribs 102 that extend about the aperture 100 and are adjacent to the crest 74. The plurality of ribs 102 straighten (that is, reduce turbulence) of water flowing over the crest 74. Illustratively, the ribs 102 generally extend in directions perpendicular to the adjacent crest portions 86, 88, 90, and 92.

Illustratively, the ribs 102 adjacent to the third crest portion 90 and the fourth crest portion 92 are spaced apart by a first distance, the ribs 102 adjacent to the first crest portion 86 and the second crest portion 88 are spaced apart by a second distance, and the first distance is greater than the second distance. Illustratively, such a spacing of the ribs 102 facilitates uniform water flow over each of the crest portions 86, 88, 90, and 92. In the illustrative embodiment of FIG. 9, the ribs 102 adjacent crest portions 86 and 88 have a spacing $d_1$, while the ribs 102 adjacent crest portions 90 and 92 have a spacing $d_2$, with spacing $d_2$ being greater than spacing $d_1$. In one illustrative embodiment, $d_1$ is approximately 0.070 inches and $d_2$ is approximately 0.165 inches.

A further illustrative faucet 210 is shown in FIGS. 11-18. Faucet 210 includes many similar components as faucet 10, where similar components are identified with like reference numbers.

Figure 11:
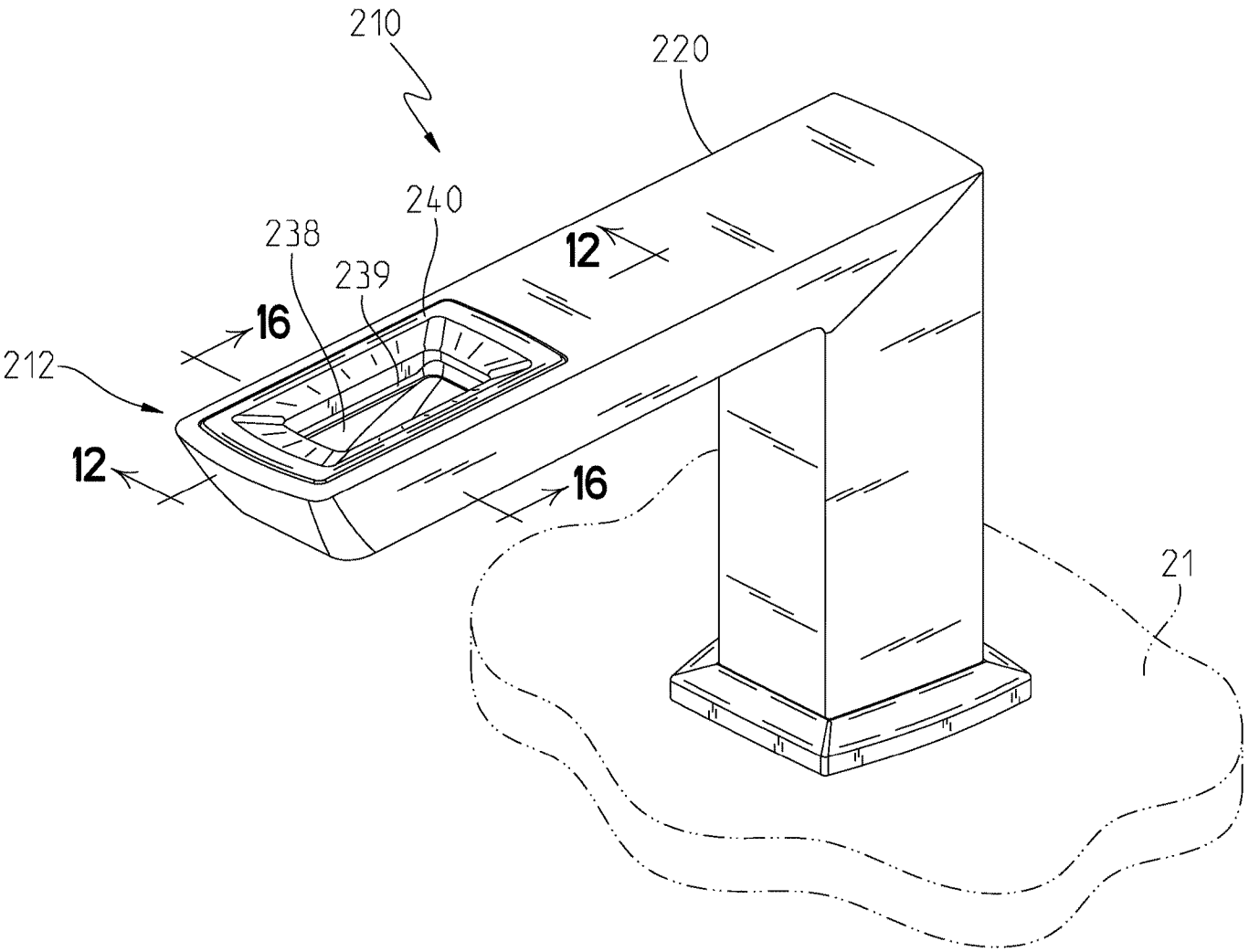
FIG. 11 is a top perspective view of a further illustrative faucet including an open waterway.
Figure 12:
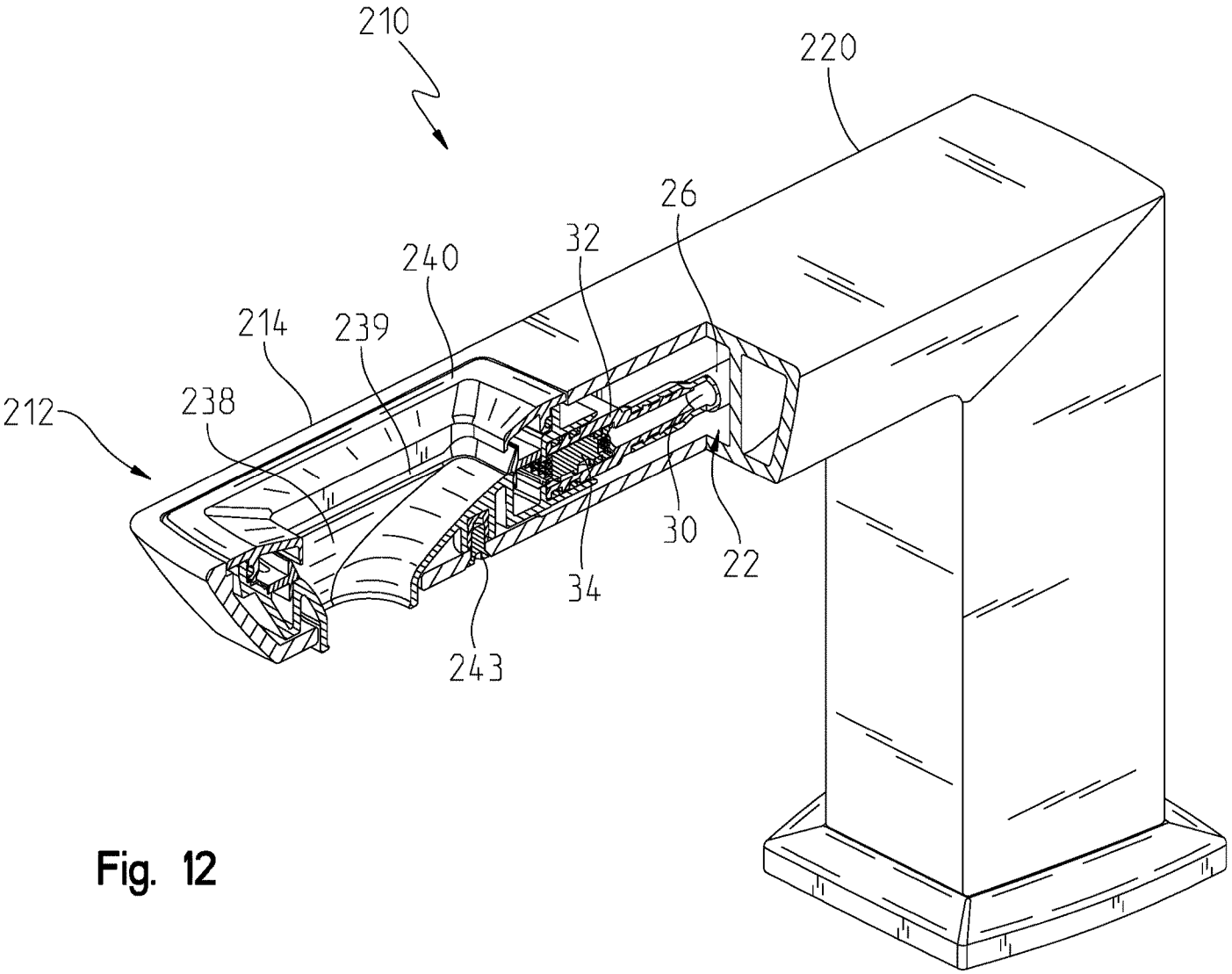
FIG. 12 is a top perspective view of the illustrative faucet of FIG. 11, with a partial cross-section of the open waterway taken along line 12-12.

As shown in FIGS. 11 and 12, the illustrative faucet 210 includes an open waterway 212 supported by an outlet end of a spout 220. The spout 220 is supported by a mounting deck, illustratively a sink deck 21. Similar to the spout 20 detailed above, the spout 220 may be formed of one or more of various materials, such as metal (for example, brass) or non-metals (for example, thermoplastic or concrete). Similarly, the spout 220 may comprise various cross-sectional shapes, such as rectangular (including square) and round (including circular).

As further detailed above, the spout 220 illustratively includes an internal passageway 22 for receiving a conduit 26 configured to receive water from one or more water sources. While a flexible conduit 26, such as a cross-linked polyethylene (PEX) tube, is shown in the illustrative embodiment, it should be appreciated that other fluid transport members may be substituted therefor. Illustratively, one or more valves may be positioned upstream from the spout 220 to deliver water to the conduit 26. In one illustrative embodiment, a mixing valve, similar to mixing valve 23, may be supported by the sink deck 21 in spaced relation to the spout 220. The internal passageway 30 of the conduit 26 is coupled to, and delivers water to, outlet 32 of the conduit 26.

Illustratively, the conduit 26 carries water conditioner 34 proximate the outlet 32. Water flows through the water conditioner 34 to facilitate one or more of aeration, stream-straightening (i.e., reducing turbulence), and limiting the flow rate of water through the faucet 10. In the illustrative embodiment, the water conditioner 34 comprises an aerator configured to straighten the water stream (i.e., reduce turbulence) and uniformly distribute water to the open waterway 212.

With reference to FIGS. 13-16, the conduit 26 delivers water to an outlet 216 of the open waterway 212. Illustratively, the open waterway 212 includes an open chamber 236 formed in the outlet end of the spout 220, a base 238 supported by the spout 220 and disposed within the open chamber 236, a flow director or baffle 239 supported by the base 238, a cover 240 supported by the baffle 239, and a seal 241 extending between the base 238 and the cover 240.

Figure 13:
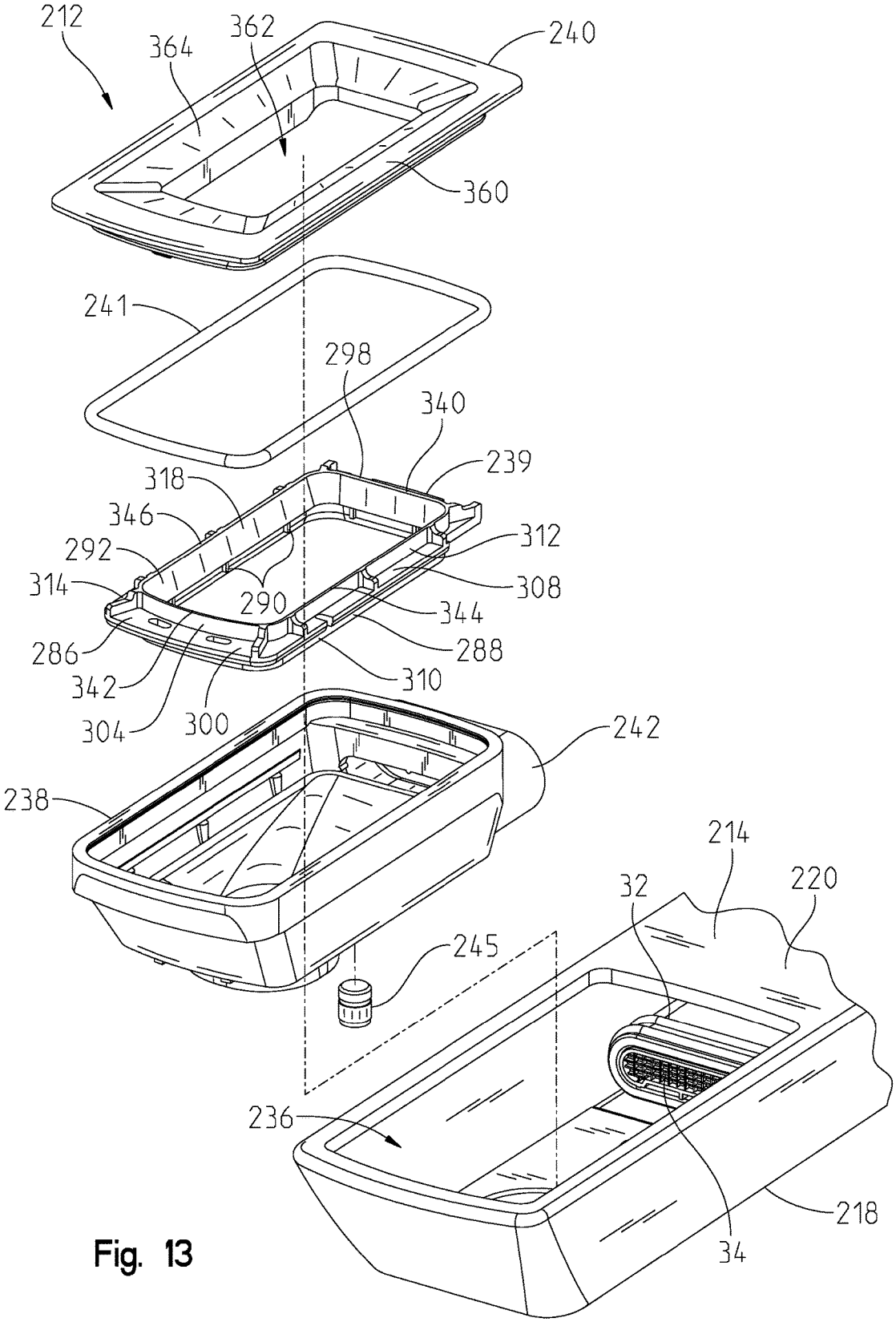
FIG. 13 is a top exploded perspective view of the open waterway of the illustrative faucet of FIG. 11.
Figure 14:
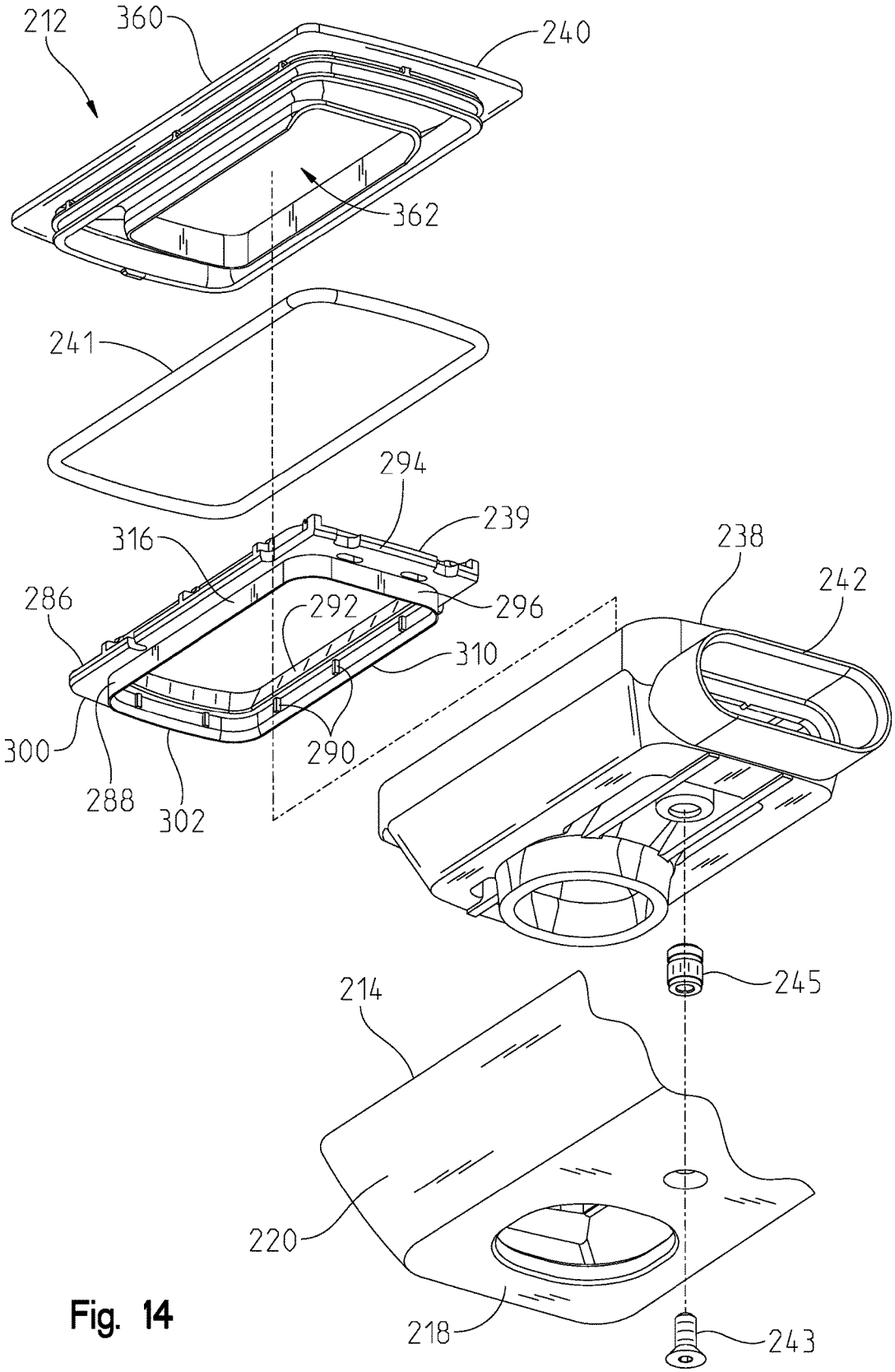
FIG. 14 is a bottom exploded perspective view of the open waterway of the illustrative faucet of FIG. 11.

With reference to FIGS. 13 and 14, the open chamber 236 of the spout 220 extends from the first side 14 of the spout 220 (for example, the top) to the second side 218 of the spout 220 (for example, the bottom). Illustratively, the open chamber 236 has a relatively large area at the first side 214 of the spout 220 and a relatively small area at the second side 18 of the spout 220. For example, the area of the open chamber 236 at the first side 214 may be from about two times (that is, two times±10 percent) to about five times (that is, five times±10 percent) the area of the open chamber 236 at the second side 218.

The base 238 may comprise one or more of various materials, such as metals (for example, stainless steel) or non-metals (for example, porcelain). In an illustrative embodiment, the base 238 may be formed of plated acrylonitrile-butadiene-styrene (ABS). Illustratively, the base 238 is formed separately from the spout 220. Alternatively, the features of the base 238 described below could be monolithically formed with the spout 220 (for example, by machining, molding, forging and/or casting).

The base 238 includes an inlet 242 that couples to, and receives water from, the conduit 26. The inlet 242 may press-fittingly couple to the conduit 26, and seals 244 may be disposed therebetween. Illustratively, the inlet 242 may have a general oval shape.

Figure 15:
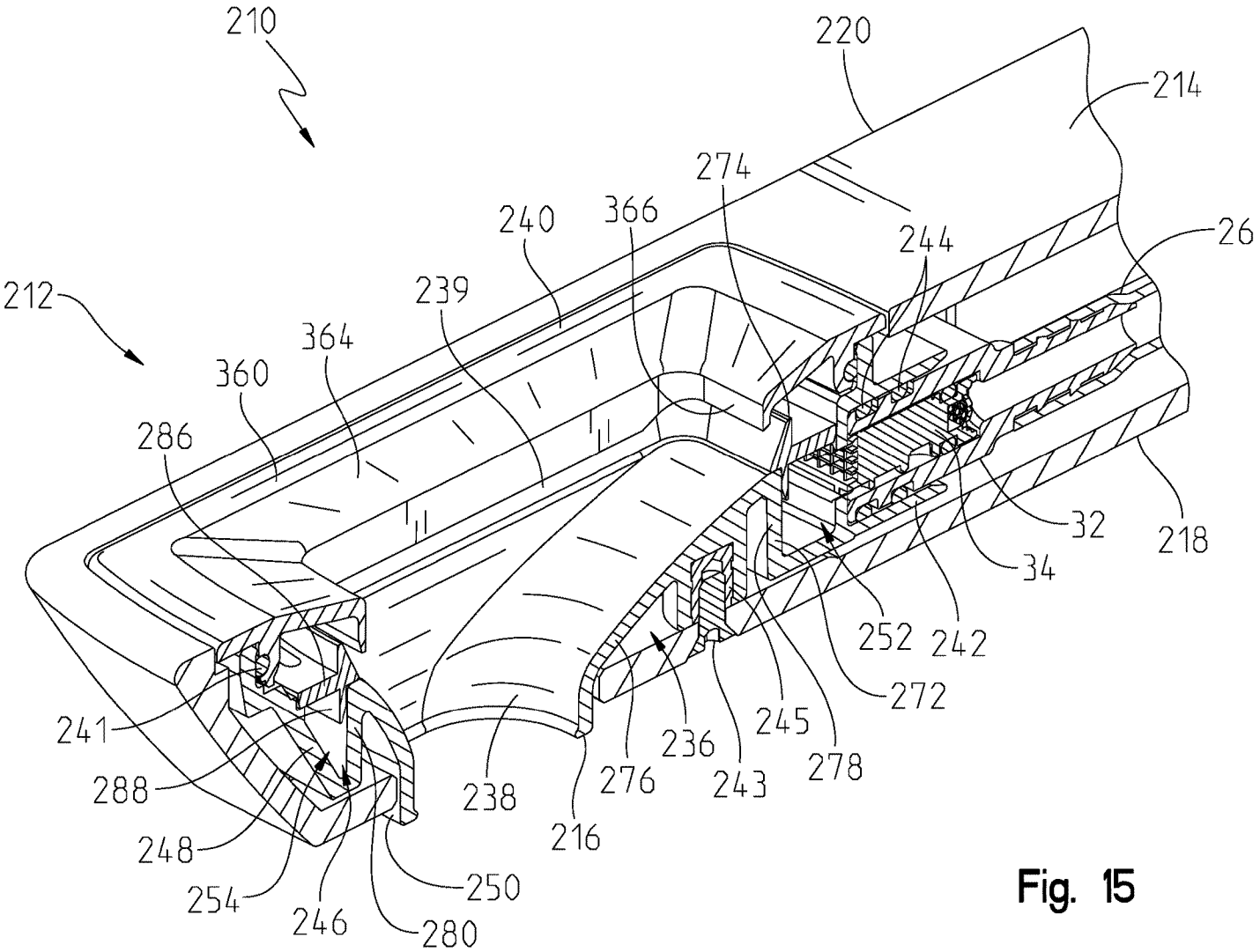
FIG. 15 is a top perspective section view of the open waterway along line 12-12 of FIG. 11.
Figure 16:
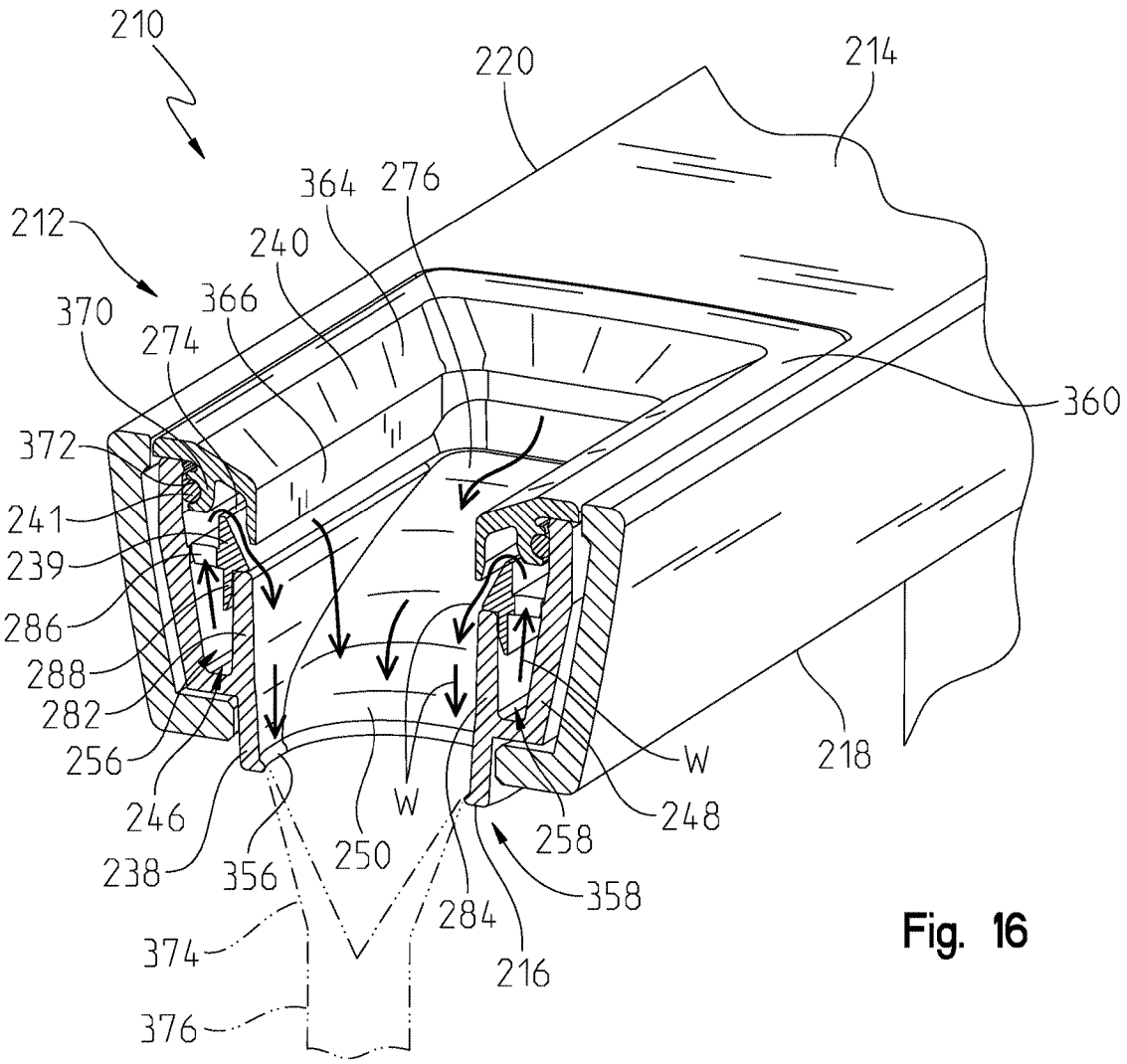
FIG. 16 is a top perspective section view of the open waterway along line 16-16 of FIG. 1.

With reference to FIGS. 15 and 16, the base 238 may be coupled to the spout 220 via a conventional fastener. Illustratively, a screw 243 is received within an insert 245 coupled to the base 238. Other conventional securing means may be substituted therefore, such as an adhesive (for example, epoxy, double-sided tape, or the like). Illustratively, the insert 245 is formed of a metal (for example, brass) and is overmolded or press-fit into the base 238.

The base 238 further includes a trough 246 that receives water from the inlet 242. The trough 246 is defined between an outer wall 248 of the base 238 and a spillway 250 of the base 238. Illustratively, the trough 246 includes a first trough portion 252, a second trough portion 254, a third trough portion 256, and a fourth trough portion 258. The first trough portion 252 is adjacent to the inlet 242. The second trough portion 254 is opposite the first trough portion 252, such that the spillway 250 is disposed between the second trough portion 254 and the first trough portion 252. The third trough portion 256 extends between the first trough portion 252 and the second trough portion 254, generally perpendicular to the first trough portion 252 and the second trough portion 254. The fourth trough portion 258 is opposite, and generally parallel to, the third trough portion 256, and extends between the first trough portion 252 and the second trough portion 254. The spillway 250 is disposed between the fourth trough portion 258 and the third trough portion 256.

The trough 246 illustratively extends around the spillway 250. The spillway 250 generally includes an intermediate side wall 272, a crest 274, and an inner chute wall 276. The side wall 272 is adjacent to and partially defines, together with the outer wall 248, the trough 246. The side wall 272 includes a first side wall portion 278, a second side wall portion 280, a third side wall portion 282, and a fourth side wall portion 284. The first side wall portion 278 is adjacent to the first trough portion 252, the second side wall portion 280 is adjacent to the second trough portion 254, the third side wall portion 282 is adjacent to the third trough portion 256, and the fourth side wall portion 284 is adjacent to the fourth trough portion 258.

With reference to FIGS. 15-18, the flow director or baffle 239 is coupled to the base 238 to enclose the trough 246. More particularly, the flow director 239 includes a horizontal baffle wall 286 and a downwardly extending connector 288. The horizontal baffle wall 286 extends between the outer wall 248 and the intermediate side wall 272 on opposite sides of the trough 246 of the base 238. The connector 288 is coupled to the side wall 272. Illustratively, a plurality of crush ribs 290 frictionally engage the side wall 272 to secure the baffle 239 to the base 238 (FIGS. 13 and 14). It should be appreciated that other securing means may be used couple the baffle 239 to the base 238, including a fastener or an adhesive. An upwardly extending wall 292 is positioned above the connector 288 and defines the crest 274.

The baffle 239 may comprise one or more of various materials, such as metals (for example, stainless steel) or non-metals (for example, a polymer or porcelain). In an illustrative embodiment, the baffle 239 may be a molded thermoplastic, such as acetal.

A first end of the baffle 239 is illustratively positioned adjacent the inlet 242 and includes a horizontal first baffle wall portion 294, a first downwardly extending connector portion 296, and a first upwardly extending wall portion 298. A second end of the baffle 239 includes a horizontal second baffle wall portion 300 positioned opposite the first baffle wall portion 294. The baffle 239 further includes a second downwardly extending connector portion 302, and a second upwardly extending wall portion 304. A first side of the baffle 239 includes a horizontal third baffle wall portion 308 extending between the first baffle wall portion 294 and the second baffle wall portion 300. The baffle 239 further includes a third downwardly extending connector portion 310, and a third upwardly extending wall portion 312. A second side of the baffle 239 includes a horizontal fourth baffle wall portion 314 opposite, and generally parallel to, the third baffle wall portion 308 and extending between the first baffle wall portion 294 and the second baffle wall portion 300. The baffle 239 further includes a fourth downwardly extending connector portion 316, and a fourth upwardly extending wall portion 318.

Figure 17:
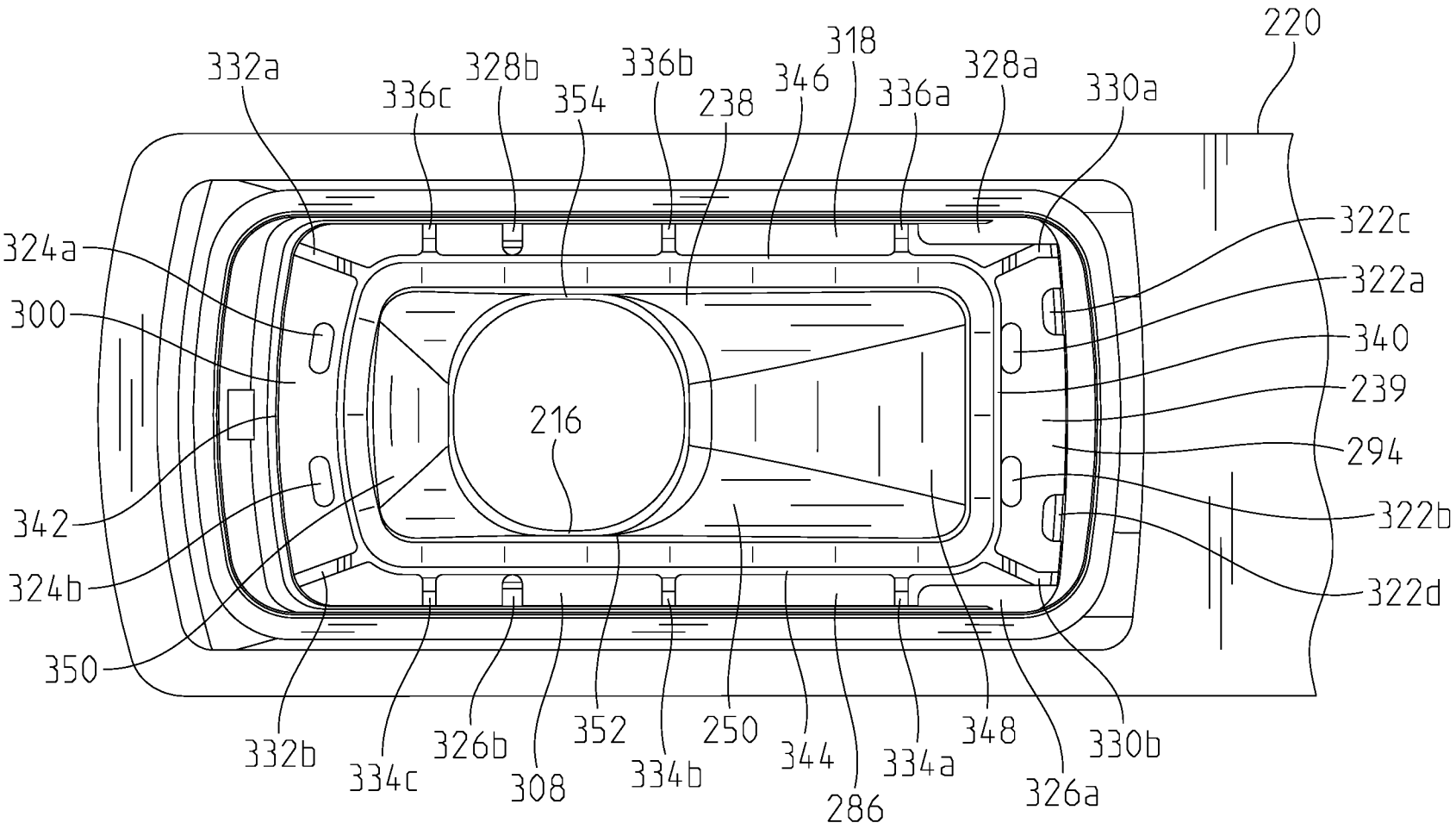
FIG. 17 is a top plan view of a spout of the faucet of FIG. 11, with the cover removed for clarity.
Figure 18:
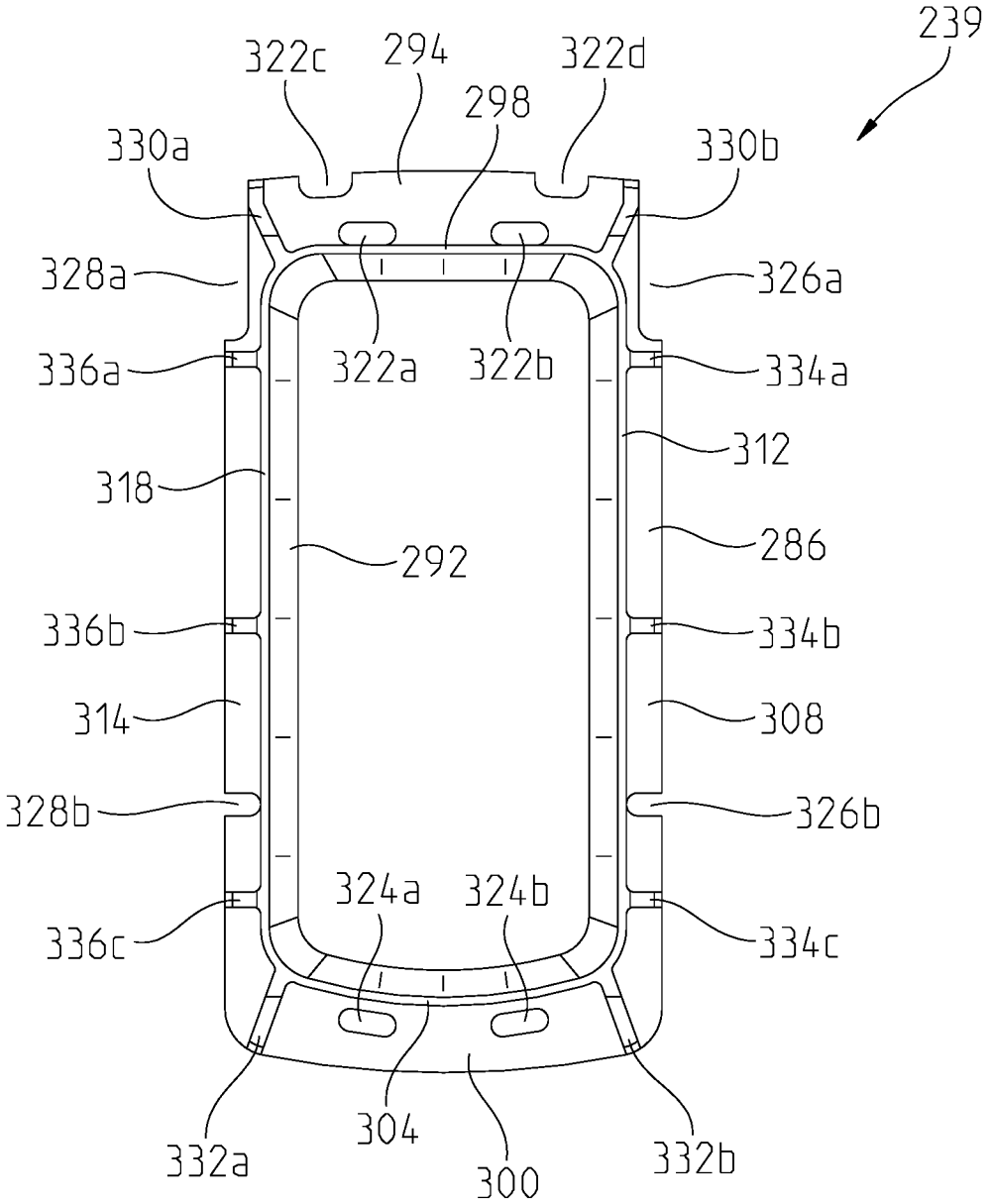
FIG. 18 is top plan view of the flow director or baffle of the open waterway.

With reference to FIGS. 17 and 18, openings within the baffle 239 provide fluid communication between the trough 246 and the spillway 250. More particularly, first fluid ports 322*a*, 322*b*, 322*c* and 322*d* are formed in the horizontal first baffle wall portion 294, second fluid ports 324*a* and 324*b* are formed in the horizontal second baffle wall portion 300, third fluid ports 326*a* and 326*b* are formed in the horizontal third baffle wall portion 308, and fourth fluid ports 328*a* and 328*b* are formed in the horizontal fourth baffle wall portion 314. While the number and positioning of the fluid ports 322, 324, 326 and 328 may vary, the cumulative flow area of the first fluid ports 322 are illustratively greater than the cumulative flow area of the second fluid ports 324, the third fluid ports 326 or the fourth fluid ports 328. In the illustrative embodiment, the increased number of first fluid ports 322 and subsequent cumulative flow area prevents an undesired spraying (e.g., "rooster tail effect") of water delivered from the waterway 212.

Flow directing ribs or dams 330, 332, 334 and 336 extend above the horizontal baffle wall 286 of the baffle 239 to separate fluid ports 322, 324, 326 and 328 and control water flow. More particularly, first flow directing ribs 330*a* and 330*b* separate first fluid ports 322*a*, 322*b*, 322*c* and 322*d*, and second flow directing ribs 332*a* and 332*b* separate second fluid ports 324*a* and 324*b*. First flow directing rib 330*b* and third flow directing rib 334*a* separate third fluid port 326*a*. Third flow directing ribs 334*b* and 334*c* separate third fluid port 326*b*. First flow directing rib 330*a* and fourth flow directing rib 336*a* separate fourth fluid port 328*a*. Finally, fourth flow directing ribs 336*b* and 336*c* separate fourth fluid port 328*b*.

With reference to FIGS. 13 and 17, the crest 274 receives water from the trough 246, and water flows over the crest 274. The crest 274 includes a first crest portion 340 defined by the first upwardly extending wall portion 298, a second crest portion 342 defined by the second upwardly extending wall portion 304, a third crest portion 344 defined by the third upwardly extending wall portion 312, and a fourth crest portion 344 defined by the fourth upwardly extending wall portion 318. The crest portions 340, 342, 344 and 346 may be disposed at appropriate perpendicular distances from the outlet 16 (that is, distances in a direction extending perpendicularly between the first side 14 of the spout 20 and the second side 218 of the spout 220) to facilitate uniform water flow over each of the crest portions 340, 342, 344 and 346. That is, the first crest portion 340 is disposed at a first perpendicular distance from the outlet 216. The second crest portion 342 is disposed at a second perpendicular distance from the outlet 216. The second perpendicular distance may be less than the first perpendicular distance. For example, the second perpendicular distance may be from about 95 percent (that is, 95 percent±2 percent) to about 80 percent (that is, 80 percent±2 percent) of the first perpendicular distance. The third crest portion 344 is disposed at a third perpendicular distance from the outlet 216. The third perpendicular distance may be less than the first perpendicular distance. For example, the third perpendicular distance may be from about 95 percent (that is, 95 percent±2 percent) to about 80 percent (that is, 80 percent±2 percent) of the first perpendicular distance. The fourth crest portion 346 is disposed at a fourth perpendicular distance from the outlet 216. The fourth perpendicular distance may be approximately equal to the first perpendicular distance (that is, equal±2 percent).

The chute wall 276 receives water flowing over the crest 274. The chute wall 276 includes a first chute wall portion 348 coupled to the first crest portion 340, and a second chute wall portion 350 coupled to the second crest portion 342. The third side wall portion 282 acts as a third chute wall portion 352, and the fourth side wall portion 284 acts as a fourth chute wall portion 354. Illustratively, water flows uniformly over the different chute wall portions 348, 350, 352 and 354. The chute wall portions 348, 350, 352 and 354 illustratively include curved surfaces that lack abrupt edges therebetween. The chute wall portions 348, 350, 352 and 354 may be disposed at different angles relative to the outlet 216. For example, the first chute wall portion 348 may be disposed at a first angle relative to the outlet 216, the second chute wall portion 350 may be disposed at a second angle relative to the outlet 216, and the second angle may be greater than the first angle. The third chute wall portion 352 (that is, the third side wall portion 282) may be disposed at a third angle relative to the outlet 216, and the third angle may be greater than the second angle. The fourth chute wall portion 354 (that is, the fourth side wall portion 284) may be disposed at a fourth angle relative to the outlet 216, and the fourth angle may be greater than the second angle. The chute walls portions 348, 350, 352 and 354 converge, proceeding from the first side 214 of the spout 220 toward the second side 218 of the spout 220, to define the outlet 216 at the second side 218 of the spout 220.

The outlet 216 may be disposed below the spout 220 to inhibit water from clinging to the second side 218 of the spout 220. Illustratively, the outlet 216 includes an inwardly extending annular lip 356 at a distal end 358. The lip 356 is configured to assist in unifying water flow and provide a cone shaping effect.

With reference to FIGS. 12-16, the cover 240 is carried by the base 238 and is disposed within the open chamber 236. The cover 240 may comprise one or more of various materials, such as metals (for example, stainless steel) or non-metals (for example, porcelain or plastic with or without plating). The cover 240 may comprise the same material as the base 238 or a different material than the base 238. For example, the cover 240 may be formed of plated acrylonitrile-butadiene-styrene (ABS). Illustratively, the cover 240 and the base 238 are coupled via the seal 241, illustratively an elastomeric o-ring. Other conventional securing means may be substituted therefore, such as a fastener or an adhesive (for example, epoxy, double-sided tape, or the like). Alternatively, the cover 240 and the base 238 are monolithically coupled (for example, by forming the components together via molding or 3D printing).

The cover 240 illustratively includes an upper wall 360 defining an aperture 362 that overlies the chute wall 276 and the outlet 216. As such, the aperture 362 facilitates visibility of water flowing over the chute wall 276 toward the outlet 216. The upper wall 360 illustratively includes a downwardly inclined portion 364 extending inwardly over the crest 274. More particularly, a downwardly extending shield or wall 366 defines the aperture 362. The gap between the crest 274 and the wall 366 defines a restricted opening 368 for water flow. A downwardly extending connecting wall 370 includes a groove 372 for receiving the o-ring 241 to seal and secure the base 238 and the cover 240.

With reference to FIGS. 15 and 16, during illustrative operation of the faucet 210, water flows through the inlet conduit 26, through the conditioner 34, and into the trough 246. The water is then directed through the fluid ports 322, 324, 326 and 328 in the baffle 239, is channeled by the directing ribs 330, 332, 334 and 336, and flows over the crest 274. The water flows down the chute wall 276 and through the outlet 216. The water defines an upper hollow conical portion 374 that tapers into a generally solid column or cylinder portion 376 (FIG. 16).

Figure 19:
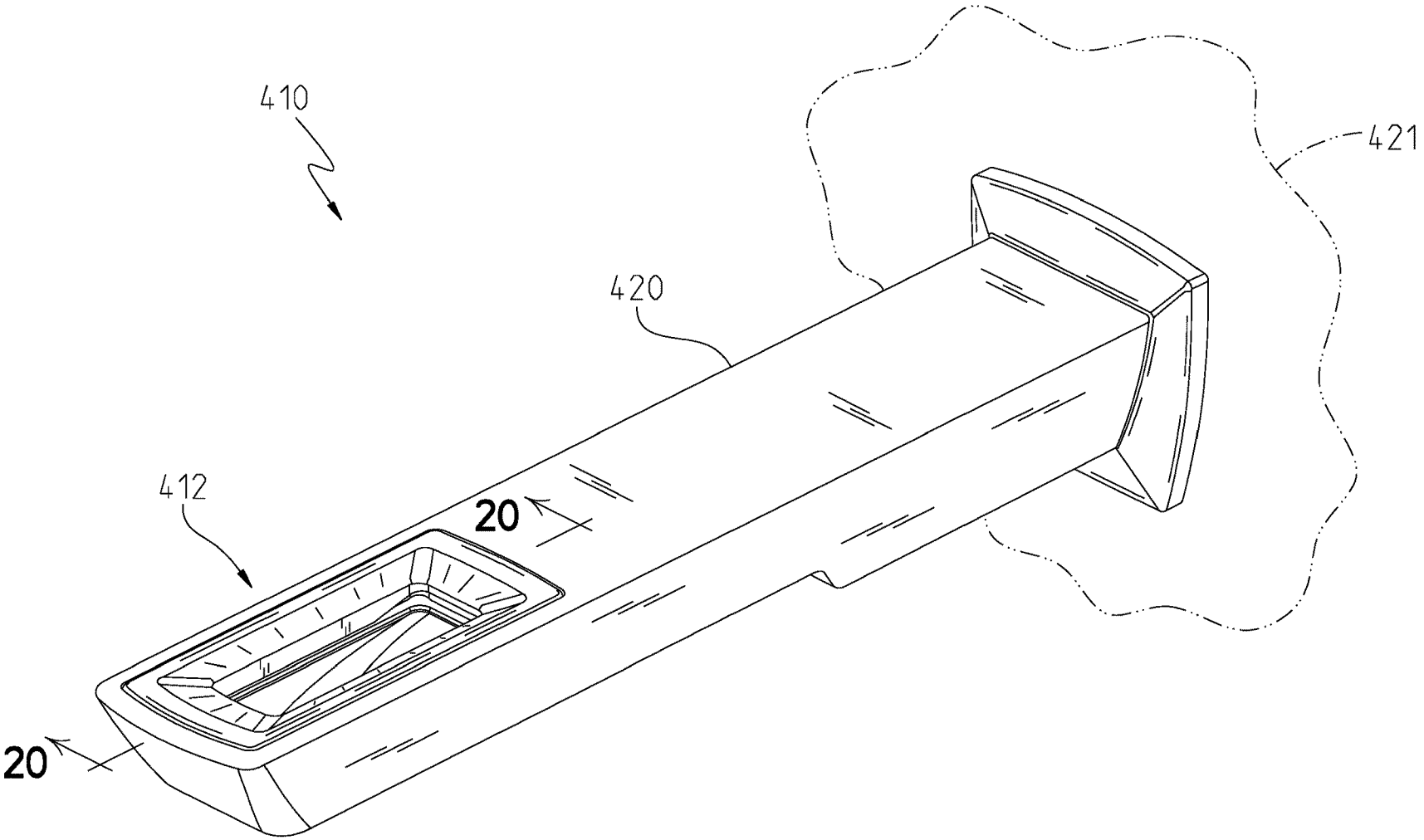
FIG. 19 is a top perspective view of a further illustrative faucet including an open waterway.
Figure 20:
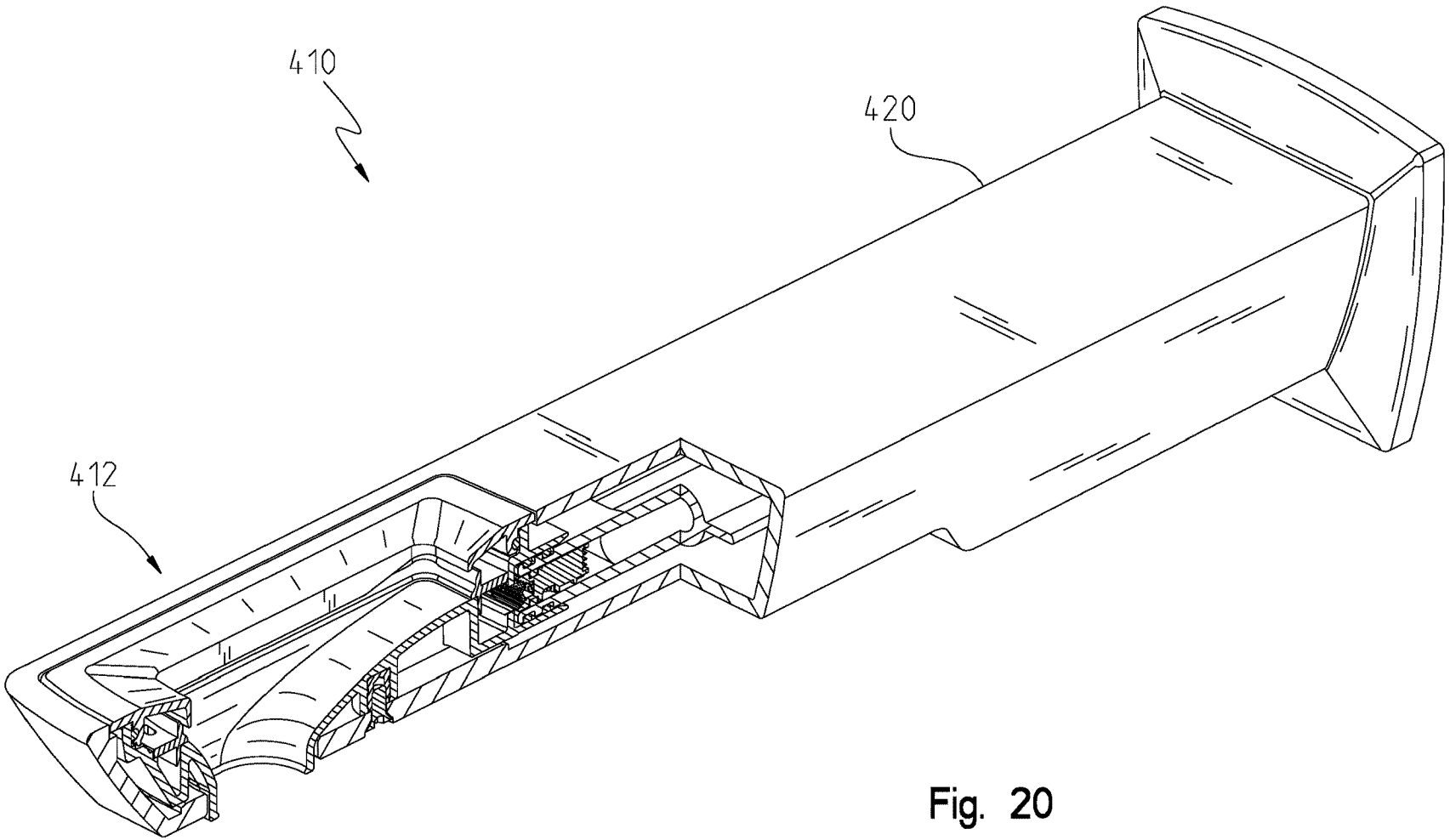
FIG. 20 is a top perspective view of the illustrative faucet of FIG. 19, with a partial cross-section of the open waterway.

A further illustrative faucet 410 is shown in FIGS. 19 and 20. Faucet 410 includes many similar components as faucet 10, where similar components are identified with like reference numbers.

The faucet 410 illustratively includes a spout 420 including an open waterway 412. The spout 420 is illustratively supported by vertical mounting surface, such as a wall 421. The open waterway 412 is substantially similar to the open waterway 212 of the spout 220 detailed above.

Various modifications and additions can be made to the embodiments described above without departing from the scope of the present disclosure. For example, while the embodiments described above refer to particular features, the scope of this disclosure also includes embodiments having different combinations of features and embodiments that do not include all of the above described features.

The invention claimed is:

1. A faucet for delivering water, comprising:

a spout comprising:

a passageway configured to receive water from a water source;

an open chamber coupled to the passageway, the open chamber extending from a first side of the spout to a second side of the spout, the second side being opposite the first side;

a trough disposed within the open chamber of the spout, the trough configured to receive water from the passageway;

a spillway disposed within the open chamber of the spout, the spillway comprising:

a crest coupled to the trough, the crest configured to permit water in the trough to flow thereover;

a chute wall coupled to the crest, the chute wall configured to receive water flowing over the crest;

an outlet defined by the chute wall at the second side of the spout, the outlet configured to deliver water from the faucet; and a plurality of ribs adjacent to the spillway, the plurality of ribs configured to at least one of reduce turbulence of water flowing over the spillway and control a direction of water flowing over the spillway.

2. The faucet of claim 1, further comprising a cover disposed within the open chamber of the spout, the cover comprising:

an aperture overlying the outlet; and the plurality of ribs, the plurality of ribs extending about the aperture.

3. The faucet of claim 1, wherein the trough extends about the spillway.

4. The faucet of claim 1, wherein the chute wall comprises:

a first chute wall portion;

a second chute wall portion opposite the first chute wall portion, and the outlet being disposed between the second chute wall portion and the first chute wall portion;

a third chute wall portion extending between the first chute wall portion and the second chute wall portion; and a fourth chute wall portion opposite the third chute wall portion and extending between the first chute wall portion and the second chute wall portion, and the outlet being disposed between the fourth chute wall portion and the third chute wall portion.

5. The faucet of claim 4, wherein the first chute wall portion is disposed at a first angle relative to the outlet, the second chute wall portion is disposed at a second angle relative to the outlet, and the second angle is greater than the first angle.

6. The faucet of claim 5, wherein the third chute wall portion is disposed at a third angle relative to the outlet, and the third angle is greater than the second angle.

7. The faucet of claim 6, wherein the fourth chute wall portion is disposed at a fourth angle relative to the outlet, and the fourth angle is greater than the second angle.

8. The faucet of claim 4, wherein the crest comprises:

a first crest portion coupled to the first chute wall portion, the first crest portion being disposed at a first perpendicular distance from the outlet;

a second crest portion coupled to the second chute wall portion, the second crest portion being disposed at a second perpendicular distance from the outlet;

a third crest portion coupled to the third chute wall portion, the third crest portion being disposed at a third perpendicular distance from the outlet;

a fourth crest portion coupled to the fourth chute wall portion, the fourth crest portion being disposed at a fourth perpendicular distance from the outlet;

wherein the first perpendicular distance is greater than the second perpendicular distance and the third perpendicular distance.

9. The faucet of claim 8, wherein the fourth perpendicular distance is greater than the second perpendicular distance and the third perpendicular distance.

10. The faucet of claim 1, further comprising a baffle wall disposed within the trough, the baffle wall configured to direct water received from the passageway transversely relative to the spillway and the outlet.

11. The faucet of claim 1, further comprising a water conditioner disposed in the passageway, the water conditioner configured to at least one of aerate, reduce turbulence, and limit a flow rate of water flowing through the passageway.

12. A faucet for delivering water, comprising:

a spout comprising:

a passageway configured to receive water from a water source;

an open chamber coupled to the passageway, the open chamber extending from a first side of the spout to a second side of the spout, the second side being opposite the first side;

a trough disposed within the open chamber of the spout, the trough configured to receive water from the passageway;

a spillway disposed within the open chamber of the spout, the spillway comprising:

a crest coupled to the trough, the crest configured to permit water in the trough to flow thereover;

a chute wall coupled to the crest, the chute wall configured to receive water flowing over the crest;

an outlet defined by the chute wall at the second side of the spout, the outlet configured to deliver water from the faucet; and a baffle wall disposed within the trough, the baffle wall configured to direct water received from the passageway relative to the spillway and the outlet.

13. The faucet of claim 12, further comprising a cover disposed within the open chamber of the spout, the cover comprising an aperture overlying the outlet.

14. The faucet of claim 12, wherein the trough comprises:

a first trough portion;

a second trough portion opposite the first trough portion, and the spillway being disposed between the second trough portion and the first trough portion;

a third trough portion extending between the first trough portion and the second trough portion; and a fourth trough portion opposite the third trough portion and extending between the first trough portion and the second trough portion, and the spillway being disposed between the fourth trough portion and the third trough portion;

wherein the baffle wall is configured to direct water received from the passageway transversely relative to the spillway and the outlet and toward the third trough portion and the fourth trough portion.

15. The faucet of claim 12, wherein the chute wall comprises:

a first chute wall portion;

a second chute wall portion opposite the first chute wall portion, and the outlet being disposed between the second chute wall portion and the first chute wall portion;

a third chute wall portion extending between the first chute wall portion and the second chute wall portion; and a fourth chute wall portion opposite the third chute wall portion and extending between the first chute wall portion and the second chute wall portion, and the outlet being disposed between the fourth chute wall portion and the third chute wall portion;

wherein the baffle wall is configured to direct water received from the passageway transversely relative to the first chute wall portion and the outlet.

16. The faucet of claim 15, wherein the first chute wall portion is disposed at a first angle relative to the outlet, the second chute wall portion is disposed at a second angle relative to the outlet, and the second angle is greater than the first angle.

17. The faucet of claim 16, wherein the third chute wall portion is disposed at a third angle relative to the outlet, and the third angle is greater than the second angle.

18. The faucet of claim 17, wherein the fourth chute wall portion is disposed at a fourth angle relative to the outlet, and the fourth angle is greater than the second angle.

19. The faucet of claim 15, wherein the crest comprises:

a first crest portion coupled to the first chute wall portion, the first crest portion being disposed at a first perpendicular distance from the outlet;

a second crest portion coupled to the second chute wall portion, the second crest portion being disposed at a second perpendicular distance from the outlet;

a third crest portion coupled to the third chute wall portion, the third crest portion being disposed at a third perpendicular distance from the outlet;

a fourth crest portion coupled to the fourth chute wall portion, the fourth crest portion being disposed at a fourth perpendicular distance from the outlet;

wherein the first perpendicular distance is greater than the second perpendicular distance and the third perpendicular distance.

20. The faucet of claim 19, wherein the fourth perpendicular distance is greater than the second perpendicular distance and the third perpendicular distance.

21. A faucet for delivering water, comprising:

a spout comprising:

a passageway configured to receive water from a water source;

an open chamber coupled to the passageway, the open chamber extending from a first side of the spout to a second side of the spout, the second side being opposite the first side;

a base disposed within the open chamber of the spout and including a trough, the trough including an inlet configured to receive water from the passageway;

a spillway disposed within the open chamber of the spout, the spillway comprising:

a crest coupled to the trough, the crest configured to permit water in the trough to flow thereover;

a chute wall coupled to the crest, the chute wall configured to receive water flowing over the crest;

an outlet defined by the chute wall at the second side of the spout, the outlet configured to deliver water from the faucet; and a baffle coupled to the base and configured to direct water received from the trough relative to the spillway and the outlet, the baffle including a baffle wall having a plurality of openings to provide fluid communication between the trough and the crest, and a plurality of flow directing ribs supported by the baffle wall to control water flow over the crest.

22. The faucet of claim 21, wherein the trough comprises:

a first trough portion;

a second trough portion opposite the first trough portion, and the spillway being disposed between the second trough portion and the first trough portion;

a third trough portion extending between the first trough portion and the second trough portion; and a fourth trough portion opposite the third trough portion and extending between the first trough portion and the second trough portion, and the spillway being disposed between the fourth trough portion and the third trough portion.

23. The faucet of claim 21, wherein the baffle wall comprises:

a first baffle wall portion positioned adjacent the inlet of the trough, the plurality of openings in the baffle wall including at least one first fluid port in the first baffle wall portion;

a second baffle wall portion opposite the first baffle wall portion, the plurality of openings in the baffle wall including at least one second fluid port in the second baffle wall portion;

a third baffle wall portion extending between the first baffle wall portion and the second baffle wall portion, the plurality of openings in the baffle wall including at least one third fluid port in the third baffle wall portion; and a fourth baffle wall portion opposite the third baffle wall portion and extending between the first baffle wall portion and the second baffle wall portion, the plurality of openings in the baffle wall including at least one fourth fluid port in the fourth baffle wall portion.

24. The faucet of claim 23, wherein the cumulative flow area of the at least one first fluid port in the first baffle wall portion is greater than the cumulative flow area of the at least one second fluid port in the second baffle wall portion.

25. The faucet of claim 23, wherein the flow directing ribs include first flow directing ribs that separate the at least one first fluid port from the other fluid ports, second flow directing ribs that separate the at least one second fluid port from the other fluid ports, third flow directing ribs that separate the at least one third fluid port from the other fluid ports, and fourth flow directing ribs that separate the at least one fourth fluid port from the other fluid ports.

26. The faucet of claim 21, wherein the chute wall comprises:

a first chute wall portion;

a second chute wall portion opposite the first chute wall portion, and the outlet being disposed between the second chute wall portion and the first chute wall portion;

a third chute wall portion extending between the first chute wall portion and the second chute wall portion; and a fourth chute wall portion opposite the third chute wall portion and extending between the first chute wall portion and the second chute wall portion, and the outlet being disposed between the fourth chute wall portion and the third chute wall portion.

27. The faucet of claim 21, further comprising a cover disposed within the open chamber of the spout, the cover comprising an aperture overlying the outlet.

28. The faucet of claim 27, wherein the cover further includes a downwardly extending shield, and a restricted opening is defined between the shield and the crest for water flow.

29. The faucet of claim 21, wherein the trough extends about the spillway.

* * * * *